US009947256B2

(12) United States Patent
Muto et al.

(10) Patent No.: US 9,947,256 B2
(45) Date of Patent: Apr. 17, 2018

(54) INTEGRATED CIRCUIT DEVICE, ELECTRONIC APPARATUS, AND CONTROL METHOD FOR ELECTROOPTIC PANEL

(71) Applicant: SEIKO EPSON CORPORATION, Tokyo (JP)

(72) Inventors: Kota Muto, Suwa (JP); Toshimichi Yamada, Fujimi-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 328 days.

(21) Appl. No.: 14/737,869

(22) Filed: Jun. 12, 2015

(65) Prior Publication Data

US 2015/0371602 A1 Dec. 24, 2015

(30) Foreign Application Priority Data

Jun. 23, 2014 (JP) ..... 2014-127928
Feb. 26, 2015 (JP) ..... 2015-036290

(51) Int. Cl.
*G09G 3/34* (2006.01)
*G09G 3/04* (2006.01)
*G09G 5/18* (2006.01)

(52) U.S. Cl.
CPC ..... *G09G 3/04* (2013.01); *G09G 3/344* (2013.01); *G09G 5/18* (2013.01); *G09G 2230/00* (2013.01); *G09G 2310/08* (2013.01); *G09G 2320/0276* (2013.01); *G09G 2320/041* (2013.01); *G09G 2370/08* (2013.01)

(58) Field of Classification Search
CPC ..... G09G 3/344; G09G 2310/06
See application file for complete search history.

(56) References Cited

U.S. PATENT DOCUMENTS 8,704,813 B2 4/2014 Hashimoto et al.
2007/0085819 A1 4/2007 Zhou et al.
2011/0069052 A1 * 3/2011 Yato ..... G09G 3/16 345/208

(Continued)

FOREIGN PATENT DOCUMENTS

JP 2007-508595 A 4/2007
JP 2011-069894 A 4/2011

(Continued)

*Primary Examiner* — Nelson Rosario
*Assistant Examiner* — Scott Au
(74) *Attorney, Agent, or Firm* — Oliff PLC

(57) ABSTRACT

An integrated circuit device includes: a timing information storage section that stores phase length information in correspondence with an index number; a waveform information storage section that stores waveform information related to a plurality of drive waveforms used in response to at least one display state; a timing control section that reads an index number included for each phase in the waveform information, reads phase length information corresponding to the index number from the timing information storage section, and sequentially generates a selection signal during a drive voltage application period corresponding to a plurality of phases; and a drive waveform selection section that selects a waveform value representing a drive voltage, out of a plurality of units of waveform information stored in the waveform information storage section, in accordance with the selection signal.

9 Claims, 14 Drawing Sheets

(56) References Cited

U.S. PATENT DOCUMENTS

| | | | | |
|---|---|---|---|---|
| 2012/0050242 | A1* | 3/2012 | Hashimoto | G09G 3/344 345/208 |
| 2013/0120333 | A1* | 5/2013 | Chien | G09G 3/344 345/208 |

FOREIGN PATENT DOCUMENTS

| | | | |
|---|---|---|---|
| JP | 2012-053084 | A | 3/2012 |
| JP | 2012-108417 | A | 6/2012 |
| JP | 5293532 | B2 | 9/2013 |
| WO | 20051038765 | A1 | 4/2005 |

* cited by examiner

FIG. 5A

Timing information at 20°C

| Frame time (ms) | 40 |
|---|---|

| Index No. (3bit) | 0 | 1 | 2 | 3 | 4 | 5 | 6 | 7 |
|---|---|---|---|---|---|---|---|---|
| Phase length (8bit) | 1 | 4 | 8 | 16 | 32 | 64 | 128 | 255 |
| Phase time (ms) | 40 | 160 | ··· | ··· | ··· | ··· | ··· | ··· |

FIG. 5B

Waveform information in drive mode 1 (high-speed mode)

| | Frame No. | | | | | | | | |
|---|---|---|---|---|---|---|---|---|---|
| | 1 | 2 | 3 | 4 | 5 | 6 | 7 | 8 | 9 |
| TP | 1 | 1 | 1 | 1 | 0 | 0 | 0 | 0 | 0 |
| BB | 1 | 1 | 1 | 1 | 0 | 0 | 0 | 0 | 0 |
| BW | 0 | 0 | 0 | 0 | 0 | 0 | 0 | 0 | 0 |
| WB | 1 | 1 | 1 | 1 | 1 | 1 | 1 | 1 | 0 |
| WW | 1 | 1 | 1 | 1 | 0 | 0 | 0 | 0 | 0 |
| Phase No. | 0 | | | | 1 | | | | 2 |
| Index No. | 1 | | | | 1 | | | | 0 |
| Phase length | 4 | | | | 4 | | | | 1 |
| Phase time (ms) | 160 | | | | 160 | | | | 40 |

FIG. 5C

Waveform information in drive mode 2 (low-ghost mode)

| | Frame No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| TP | 0 | 0 | 0 | 0 | 1 | 1 | 1 | 1 | 0 | 0 | 0 | 0 | 0 |
| BB | 0 | 0 | 0 | 0 | 0 | 0 | 0 | 0 | 1 | 1 | 1 | 1 | 0 |
| BW | 0 | 0 | 0 | 0 | 0 | 0 | 0 | 0 | 0 | 0 | 0 | 0 | 0 |
| WB | 1 | 1 | 1 | 1 | 0 | 0 | 0 | 0 | 1 | 1 | 1 | 1 | 0 |
| WW | 1 | 1 | 1 | 1 | 0 | 0 | 0 | 0 | 0 | 0 | 0 | 0 | 0 |
| Phase No. | 0 | | | | 1 | | | | 2 | | | | 3 |
| Index No. | 1 | | | | 1 | | | | 1 | | | | 0 |
| Phase length | 4 | | | | 4 | | | | 4 | | | | 1 |
| Phase time (ms) | 160 | | | | 160 | | | | 160 | | | | 40 |

FIG. 6A Timing information at 0°C

| Frame time (ms) | 80 |
|---|---|

| Index No. (3bit) | 0 | 1 | 2 | 3 | 4 | 5 | 6 | 7 |
|---|---|---|---|---|---|---|---|---|
| Phase length (8bit) | 1 | 25 | 8 | 16 | 32 | 64 | 128 | 255 |
| Phase time (ms) | 80 | 2000 | ··· | ··· | ··· | ··· | ··· | ··· |

FIG. 6B Waveform information in drive mode 1 (high-speed mode)

| | Frame No. | | | | | | | | | | |
|---|---|---|---|---|---|---|---|---|---|---|---|
| | 1 | 2 | 3 | ··· | 25 | 26 | 27 | 28 | ··· | 50 | 51 |
| TP | 1 | 1 | 1 | ··· | 1 | 0 | 0 | 0 | ··· | 0 | 0 |
| BB | 1 | 1 | 1 | ··· | 1 | 0 | 0 | 0 | ··· | 0 | 0 |
| BW | 0 | 0 | 0 | ··· | 0 | 0 | 0 | 0 | ··· | 0 | 0 |
| WB | 1 | 1 | 1 | ··· | 1 | 1 | 1 | 1 | ··· | 1 | 0 |
| WW | 1 | 1 | 1 | ··· | 1 | 0 | 0 | 0 | ··· | 0 | 0 |
| Phase No. | 0 | | | | | 1 | | | | | 2 |
| Index No. | 1 | | | | | 1 | | | | | 0 |
| Phase length | 25 | | | | | 25 | | | | | 1 |
| Phase time (ms) | 2000 | | | | | 2000 | | | | | 80 |

FIG. 6C Waveform information in drive mode 2 (low-ghost mode)

| | Frame No. | | | | | | | | | | | | | | | |
|---|---|---|---|---|---|---|---|---|---|---|---|---|---|---|---|---|
| | 1 | 2 | 3 | ··· | 25 | 26 | 27 | 28 | ··· | 50 | 51 | 52 | 53 | ··· | 75 | 76 |
| TP | 0 | 0 | 0 | ··· | 0 | 1 | 1 | 1 | ··· | 1 | 0 | 0 | 0 | ··· | 0 | 0 |
| BB | 0 | 0 | 0 | ··· | 0 | 0 | 0 | 0 | ··· | 0 | 1 | 1 | 1 | ··· | 1 | 0 |
| BW | 0 | 0 | 0 | ··· | 0 | 0 | 0 | 0 | ··· | 0 | 0 | 0 | 0 | ··· | 0 | 0 |
| WB | 1 | 1 | 1 | ··· | 1 | 0 | 0 | 0 | ··· | 0 | 1 | 1 | 1 | ··· | 1 | 0 |
| WW | 1 | 1 | 1 | ··· | 1 | 0 | 0 | 0 | ··· | 0 | 0 | 0 | 0 | ··· | 0 | 0 |
| Phase No. | 0 | | | | | 1 | | | | | 2 | | | | | 3 |
| Index No. | 1 | | | | | 1 | | | | | 1 | | | | | 0 |
| Phase length | 25 | | | | | 25 | | | | | 25 | | | | | 1 |
| Phase time (ms) | 2000 | | | | | 2000 | | | | | 2000 | | | | | 80 |

FIG. 7A

Timing information at 50°C

| Frame time (ms) | 20 |
|---|---|

| Index No. (3bit) | 0 | 1 | 2 | 3 | 4 | 5 | 6 | 7 |
|---|---|---|---|---|---|---|---|---|
| Phase length (8bit) | 1 | 5 | 8 | 16 | 32 | 64 | 128 | 255 |
| Phase time (ms) | 20 | 100 | ··· | ··· | ··· | ··· | ··· | ··· |

FIG. 7B

Waveform information in drive mode 1 (high-speed mode)

| | Frame No. | | | | | | | | | | |
|---|---|---|---|---|---|---|---|---|---|---|---|
| | 1 | 2 | 3 | 4 | 5 | 6 | 7 | 8 | 9 | 10 | 11 |
| TP | 1 | 1 | 1 | 1 | 1 | 0 | 0 | 0 | 0 | 0 | 0 |
| BB | 1 | 1 | 1 | 1 | 1 | 0 | 0 | 0 | 0 | 0 | 0 |
| BW | 0 | 0 | 0 | 0 | 0 | 0 | 0 | 0 | 0 | 0 | 0 |
| WB | 1 | 1 | 1 | 1 | 1 | 1 | 1 | 1 | 1 | 1 | 0 |
| WW | 1 | 1 | 1 | 1 | 1 | 0 | 0 | 0 | 0 | 0 | 0 |
| Phase No. | 0 | | | | | 1 | | | | | 2 |
| Index No. | 1 | | | | | 1 | | | | | 0 |
| Phase length | 5 | | | | | 5 | | | | | 1 |
| Phase time (ms) | 100 | | | | | 100 | | | | | 20 |

FIG. 7C

Waveform information in drive mode 2 (low-ghost mode)

| | Frame No. | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| TP | 0 | 0 | 0 | 0 | 0 | 1 | 1 | 1 | 1 | 1 | 0 | 0 | 0 | 0 | 0 | 0 |
| BB | 0 | 0 | 0 | 0 | 0 | 0 | 0 | 0 | 0 | 0 | 1 | 1 | 1 | 1 | 1 | 0 |
| BW | 0 | 0 | 0 | 0 | 0 | 0 | 0 | 0 | 0 | 0 | 0 | 0 | 0 | 0 | 0 | 0 |
| WB | 1 | 1 | 1 | 1 | 1 | 0 | 0 | 0 | 0 | 0 | 1 | 1 | 1 | 1 | 1 | 0 |
| WW | 1 | 1 | 1 | 1 | 1 | 0 | 0 | 0 | 0 | 0 | 0 | 0 | 0 | 0 | 0 | 0 |
| Phase No. | 0 | | | | | 1 | | | | | 2 | | | | | 3 |
| Index No. | 1 | | | | | 1 | | | | | 1 | | | | | 0 |
| Phase length | 5 | | | | | 5 | | | | | 5 | | | | | 1 |
| Phase time (ms) | 100 | | | | | 100 | | | | | 100 | | | | | 20 |

FIG. 8A

Timing information at 20°C

| Frame time (ms) | 40 |
|---|---|

| Index No. (3bit) | 0 | 1 | 2 | 3 | 4 | 5 | 6 | 7 |
|---|---|---|---|---|---|---|---|---|
| Phase length (8bit) | 1 | 4 | 2 | 16 | 32 | 64 | 128 | 255 |
| Phase time (ms) | 40 | 160 | 80 | ··· | ··· | ··· | ··· | ··· |

FIG. 8B

Waveform information in drive mode 1 (high-speed mode)

| | Frame No. | | | | | | | | |
|---|---|---|---|---|---|---|---|---|---|
| | 1 | 2 | 3 | 4 | 5 | 6 | 7 | 8 | 9 |
| TP | 1 | 1 | 1 | 1 | 0 | 0 | 0 | 0 | 0 |
| BB | 1 | 1 | 1 | 1 | 0 | 0 | 0 | 0 | 0 |
| BW | 0 | 0 | 0 | 0 | 0 | 0 | 0 | 0 | 0 |
| WB | 1 | 1 | 1 | 1 | 1 | 1 | 1 | 1 | 0 |
| WW | 1 | 1 | 1 | 1 | 0 | 0 | 0 | 0 | 0 |
| Phase No. | 0 | | | | 1 | | | | 2 |
| Index No. | 1 | | | | 1 | | | | 0 |
| Phase length | 4 | | | | 4 | | | | 1 |
| Phase time (ms) | 160 | | | | 160 | | | | 40 |

FIG. 8C

Waveform information in drive mode 2 (low-ghost mode)

| | Frame No. | | | | | | | | | | | | | | | | | | | | |
|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 |
| TP | 0 | 0 | 0 | 0 | 1 | 1 | 0 | 0 | 1 | 1 | 0 | 0 | 1 | 1 | 1 | 1 | 0 | 0 | 0 | 0 | 0 |
| BB | 0 | 0 | 0 | 0 | 0 | 0 | 1 | 1 | 0 | 0 | 1 | 1 | 0 | 0 | 0 | 0 | 1 | 1 | 1 | 1 | 0 |
| BW | 0 | 0 | 0 | 0 | 0 | 0 | 1 | 1 | 0 | 0 | 1 | 1 | 0 | 0 | 0 | 0 | 0 | 0 | 0 | 0 | 0 |
| WB | 1 | 1 | 1 | 1 | 0 | 0 | 1 | 1 | 0 | 0 | 1 | 1 | 0 | 0 | 0 | 0 | 1 | 1 | 1 | 1 | 0 |
| WW | 1 | 1 | 1 | 1 | 0 | 0 | 1 | 1 | 0 | 0 | 1 | 1 | 0 | 0 | 0 | 0 | 0 | 0 | 0 | 0 | 0 |
| Phase No. | 0 | | | | 1 | | 2 | | 3 | | 4 | | 5 | | | | 6 | | | | 7 |
| Index No. | 1 | | | | 2 | | 2 | | 2 | | 2 | | 1 | | | | 1 | | | | 0 |
| Phase length | 4 | | | | 2 | | 2 | | 2 | | 2 | | 4 | | | | 4 | | | | 1 |
| Phase time (ms) | 160 | | | | 80 | | 80 | | 80 | | 80 | | 160 | | | | 160 | | | | 40 |

FIG. 9A Timing information at 0°C

| Frame time (ms) | 80 |
|---|---|

| Index No. (3bit) | 0 | 1 | 2 | 3 | 4 | 5 | 6 | 7 |
|---|---|---|---|---|---|---|---|---|
| Phase length (8bit) | 1 | 25 | 12 | 16 | 32 | 64 | 128 | 255 |
| Phase time (ms) | 80 | 2000 | 960 | ··· | ··· | ··· | ··· | ··· |

FIG. 9B Waveform information in drive mode 1 (high-speed mode)

| | Frame No. | | | | | | | | | | |
|---|---|---|---|---|---|---|---|---|---|---|---|
| | 1 | 2 | 3 | ··· | 25 | 26 | 27 | 28 | ··· | 50 | 51 |
| TP | 1 | 1 | 1 | ··· | 1 | 0 | 0 | 0 | ··· | 0 | 0 |
| BB | 1 | 1 | 1 | ··· | 1 | 0 | 0 | 0 | ··· | 0 | 0 |
| BW | 0 | 0 | 0 | ··· | 0 | 0 | 0 | 0 | ··· | 0 | 0 |
| WB | 1 | 1 | 1 | ··· | 1 | 1 | 1 | 1 | ··· | 1 | 0 |
| WW | 1 | 1 | 1 | ··· | 1 | 0 | 0 | 0 | ··· | 0 | 0 |
| Phase No. | 0 | | | | | 1 | | | | | 2 |
| Index No. | 1 | | | | | 1 | | | | | 0 |
| Phase length | 25 | | | | | 25 | | | | | 1 |
| Phase time (ms) | 2000 | | | | | 2000 | | | | | 80 |

FIG. 9C Waveform information in drive mode 2 (low-ghost mode)

| | Frame No. | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | ··· | 25 | 26 | ··· | 37 | 38 | ··· | 49 | 50 | ··· | 61 | 62 | ··· | 73 | 74 | 75 | ··· | 98 | 99 | 100 | ··· | 123 | 124 |
| TP | 0 | 0 | ··· | 0 | 1 | ··· | 1 | 0 | ··· | 0 | 1 | ··· | 1 | 0 | ··· | 0 | 1 | 1 | ··· | 1 | 0 | 0 | ··· | 0 | 0 |
| BB | 0 | 0 | ··· | 0 | 0 | ··· | 0 | 1 | ··· | 1 | 0 | ··· | 0 | 1 | ··· | 1 | 0 | 0 | ··· | 0 | 1 | 1 | ··· | 1 | 0 |
| BW | 0 | 0 | ··· | 0 | 0 | ··· | 0 | 1 | ··· | 1 | 0 | ··· | 0 | 1 | ··· | 1 | 0 | 0 | ··· | 0 | 0 | 0 | ··· | 0 | 0 |
| WB | 1 | 1 | ··· | 1 | 0 | ··· | 0 | 1 | ··· | 1 | 0 | ··· | 0 | 1 | ··· | 1 | 0 | 0 | ··· | 0 | 1 | 1 | ··· | 1 | 0 |
| WW | 1 | 1 | ··· | 1 | 0 | ··· | 0 | 1 | ··· | 1 | 0 | ··· | 0 | 1 | ··· | 1 | 0 | 0 | ··· | 0 | 0 | 0 | ··· | 0 | 0 |
| Phase No. | 0 | | | | 1 | | | 2 | | | 3 | | | 4 | | | 5 | | | | 6 | | | | 7 |
| Index No. | 1 | | | | 2 | | | 2 | | | 2 | | | 2 | | | 1 | | | | 1 | | | | 0 |
| Phase length | 25 | | | | 12 | | | 12 | | | 12 | | | 12 | | | 25 | | | | 25 | | | | 1 |
| Phase time (ms) | 2000 | | | | 960 | | | 960 | | | 960 | | | 960 | | | 2000 | | | | 2000 | | | | 80 |

FIG. 10A Timing information at 50°C

| Frame time (ms) | 20 |
|---|---|

| Index No. (3bit) | 0 | 1 | 2 | 3 | 4 | 5 | 6 | 7 |
|---|---|---|---|---|---|---|---|---|
| Phase length (8bit) | 1 | 5 | 2 | 16 | 32 | 64 | 128 | 255 |
| Phase time (ms) | 20 | 100 | 40 | ··· | ··· | ··· | ··· | ··· |

FIG. 10B Waveform information in drive mode 1 (high-speed mode)

| | Frame No. | | | | | | | | | | |
|---|---|---|---|---|---|---|---|---|---|---|---|
| | 1 | 2 | 3 | 4 | 5 | 6 | 7 | 8 | 9 | 10 | 11 |
| TP | 1 | 1 | 1 | 1 | 1 | 0 | 0 | 0 | 0 | 0 | 0 |
| BB | 1 | 1 | 1 | 1 | 1 | 0 | 0 | 0 | 0 | 0 | 0 |
| BW | 0 | 0 | 0 | 0 | 0 | 0 | 0 | 0 | 0 | 0 | 0 |
| WB | 1 | 1 | 1 | 1 | 1 | 1 | 1 | 1 | 1 | 1 | 0 |
| WW | 1 | 1 | 1 | 1 | 1 | 0 | 0 | 0 | 0 | 0 | 0 |
| Phase No. | 0 | | | | | 1 | | | | | 2 |
| Index No. | 1 | | | | | 1 | | | | | 0 |
| Phase length | 5 | | | | | 5 | | | | | 1 |
| Phase time (ms) | 100 | | | | | 100 | | | | | 20 |

FIG. 10C Waveform information in drive mode 2 (low-ghost mode)

| | Frame No. | | | | | | | | | | | | | | | | | | | | | | | |
|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
| TP | 0 | 0 | 0 | 0 | 0 | 1 | 1 | 0 | 0 | 1 | 1 | 0 | 0 | 1 | 1 | 1 | 1 | 1 | 0 | 0 | 0 | 0 | 0 | 0 |
| BB | 0 | 0 | 0 | 0 | 0 | 0 | 0 | 1 | 1 | 0 | 0 | 1 | 1 | 0 | 0 | 0 | 0 | 0 | 1 | 1 | 1 | 1 | 1 | 0 |
| BW | 0 | 0 | 0 | 0 | 0 | 0 | 0 | 1 | 1 | 0 | 0 | 1 | 1 | 0 | 0 | 0 | 0 | 0 | 0 | 0 | 0 | 0 | 0 | 0 |
| WB | 1 | 1 | 1 | 1 | 1 | 0 | 0 | 1 | 1 | 0 | 0 | 1 | 1 | 0 | 0 | 0 | 0 | 0 | 1 | 1 | 1 | 1 | 1 | 0 |
| WW | 1 | 1 | 1 | 1 | 1 | 0 | 0 | 1 | 1 | 0 | 0 | 1 | 1 | 0 | 0 | 0 | 0 | 0 | 0 | 0 | 0 | 0 | 0 | 0 |
| Phase No. | 0 | | | | | 1 | | 2 | | 3 | | 4 | | 5 | | | | | 6 | | | | | 7 |
| Index No. | 1 | | | | | 2 | | 2 | | 2 | | 2 | | 1 | | | | | 1 | | | | | 0 |
| Phase length | 5 | | | | | 2 | | 2 | | 2 | | 2 | | 5 | | | | | 5 | | | | | 1 |
| Phase time (ms) | 100 | | | | | 40 | | 40 | | 40 | | 40 | | 100 | | | | | 100 | | | | | 20 |

FIG. 11A

| Frame time (ms) | 40 |
|---|---|

| Index No. (3bit) | 0 | 1 | 2 | 3 | 4 | 5 | 6 | 7 |
|---|---|---|---|---|---|---|---|---|
| Phase length (8bit) | 0 | 1 | 4 | 8 | 16 | 32 | 64 | 128 |
| Phase time (ms) | 0 | 40 | 160 | ··· | ··· | ··· | ··· | ··· |

FIG. 11B

Drive mode 2 (low-ghost mode), normal temperature

| Index No. | | | | | | | | | White-black overall |
|---|---|---|---|---|---|---|---|---|---|
| – | 2 | 2 | 2 | 2 | 0 | 0 | 2 | 1 | 2 |
| Previous image → | All black → | All white → | All black → | All white → | Skip → | Skip → | Black write → | Charge release | |

FIG. 11C

Drive mode 2 (low-ghost mode), low temperature

| Index No. | | | | | | | | | White-black overall |
|---|---|---|---|---|---|---|---|---|---|
| – | 2 | 2 | 2 | 2 | 2 | 2 | 2 | 1 | 3 |
| Previous image → | All black → | All white → | All black → | All white → | All black → | All white → | Black write → | Charge release | |

FIG. 11D

Drive mode 2 (low-ghost mode), high temperature

| Index No. | | | | | | | | | White-black overall |
|---|---|---|---|---|---|---|---|---|---|
| – | 2 | 2 | 0 | 0 | 0 | 0 | 2 | 1 | 1 |
| Previous image → | All black → | All white → | Skip → | Skip → | Skip → | Skip → | Black write → | Charge release | |

Drive mode 1 (high-speed mode)

| | Frame No. | | | | | | | | |
|---|---|---|---|---|---|---|---|---|---|
| | 1 | 2 | 3 | 4 | 5 | 6 | 7 | 8 | 9 |
| TP | 0 | 0 | 0 | 0 | 1 | 1 | 1 | 1 | 0 |
| B | 1 | 1 | 1 | 1 | 1 | 1 | 1 | 1 | 0 |
| W | 0 | 0 | 0 | 0 | 0 | 0 | 0 | 0 | 0 |
| Phase No. | 0 | | | | 1 | | | | 2 |
| Index No. | 1 | | | | 1 | | | | 0 |
| Phase length | 4 | | | | 4 | | | | 1 |
| Phase time(ms) | 160 | | | | 160 | | | | 40 |

FIG. 14

Drive mode 1 (high-speed mode)

| | | | | | |
|---|---|---|---|---|---|
| | 1 | 2 | 3 | 4 | 5 |
| BB | 0 | 0 | 0 | 0 | 0 |
| BW | −1 | −1 | −1 | −1 | 0 |
| WB | +1 | +1 | +1 | +1 | 0 |
| WW | 0 | 0 | 0 | 0 | 0 |
| Phase No. | 0 | | | | 1 |
| Index No. | 1 | | | | 0 |
| Phase length | 4 | | | | 1 |
| Phase time(ms) | 160 | | | | 40 |

FIG. 15

INTEGRATED CIRCUIT DEVICE, ELECTRONIC APPARATUS, AND CONTROL METHOD FOR ELECTROOPTIC PANEL

BACKGROUND

1. Technical Field

The present invention relates to an integrated circuit device that generates a drive voltage waveform (hereinafter simply referred to as a "drive waveform") used for drive of an electrooptic panel such as an electrophoretic display (EPD) panel, and an electronic apparatus equipped with such an integrated circuit device. The invention further relates to a control method for an electrooptic panel.

2. Related Art

As a display device that achieves further more reduction in thickness and power consumption than a liquid crystal display device and a plasma display device, a display device using an EPD panel, etc., also called electronic paper, has been developed, and is being used in an electronic apparatus such as a wristwatch, an electronic book, an electronic newspaper, an electronic advertising signboard, and a guideboard.

In an EPD panel, for example, an electrophoretic layer is formed between a transparent top plane electrode provided on a surface layer and a plurality of segment electrodes provided on a bottom layer. The electrophoretic layer includes microcapsules each housing white electrophoretic particles and black electrophoretic particles charged to different polarities and a dispersion medium (transparent oil, etc.) for dispersing the particles.

By applying a voltage between the top plane electrode and a segment electrode to apply an electric field on the electrophoretic particles, the electrophoretic particles move depending on the direction of the electric field, thereby displaying the color of a pixel corresponding to the segment electrode. The EPD panel has a nonvolatile (memory) property in which, once an electric field is applied to electrophoretic particles to put the panel in a display state, the display state is maintained thereafter with no electric field being applied to the electrophoretic particles. Therefore, since it is only necessary to apply an electric field to the electrophoretic particles when display is first performed and when the contents of the display are changed or deleted, wide power savings can be made.

In driving the EPD panel, the voltages applied between the top plane electrode and the segment electrodes are changed in accordance with their drive waveforms during the time until the display state of the EPD panel changes from a first display state corresponding to first display data to a second display state corresponding to second display data, thereby stabilizing the display state.

To achieve the above, a display device using an electrooptic panel such as the EPD panel uses an integrated circuit device (display controller or display driver) that sets drive waveforms used for driving the electrooptic panel, or sets drive waveforms and drives the electrooptic panel. Also, since the characteristics of the EPD panel are sensitive to temperature, the drive waveforms are compensated in response to a change in temperature.

As related technology, JP-A-2007-508595 (Abstract, Table 1: Patent Document 1) discloses a method and system that control electrophoretic and other bistable displays. Coded data for different pixel transitions and different temperatures for driving a display is stored in memory (LUT1 to LUT15, etc.). The coded data has voltage levels and timing information for different pixel transitions. Part of the coded data is retrieved by a controller based on selected pixel transition, temperature, and updated mode. Part of the coded data including a fixed-length frame instruction is decoded, and the decoded data provides a voltage waveform for driving the display.

JP-A-2012-53084 (para. 0007-0008, FIG. 6: Patent Document 2) discloses an integrated circuit device that easily responds to a plurality of drive styles in driving an electrooptic panel such as an EPD panel. This integrated circuit device includes a drive voltage generation section that outputs a drive voltage supplied to a segment electrode of the electrooptic panel, a display data memory section that stores at least first display data and second display data, and a drive waveform information output section that outputs drive waveform information at the time when the display state of the segment electrode changes from a first display state corresponding to the first display data to a second display state corresponding to the first display data.

The drive waveform information output section has a first memory section that stores drive waveform information in each of basic periods T1 to TM (M is an integer equal to or more than 2), a second memory section that stores a first designated period designating at least one basic period out of the basic periods T1 to TM and a first number of times of repetition of the first designated period, and an output section that outputs drive waveform information corresponding to each of the basic periods T1 to TM, the first designated period, and the periods specified by the first number of times of repetition. The drive voltage generation section outputs a drive voltage specified by the first and second display data from the display data memory section and the drive waveform information from the drive waveform information output section.

Japanese Patent No. 5,293,532 (para. 0006-0011, FIG. 6: Patent Document 3) discloses an integrated circuit device that permits sequential drive of an electrooptic panel while seeking to reduce the processing load on a control device. In this integrated circuit device, a drive waveform information output section includes registers RT1 to RTM (M is an integer equal to or more than 2), where a register RTk ($1 \le k \le M$) out of the registers RT1 to RTM stores a register value specifying the signal level of a drive waveform signal during a period Tk out of the periods T1 to TM and a period length register value for setting the length of the period Tk.

During a period Tp ($1 \le p \le M-1$) out of the periods T1 to TM, the drive waveform information output section sets the length of the period Tp based on the period length register value from a register RTp, and outputs a register value specifying the signal level from the register RTp. During a period Tp+1 subsequent to the period Tp, the drive waveform information output section sets the length of the period Tp+1 based on the period length register value from the register RTp+1 and outputs a register value specifying the signal level from the register RTp+1.

In Patent Document 1, where temperature-specific look-up tables (LUTs) (see Table 1 in Patent Document 1) are used, the same number of LUTs as the number of temperature ranges for which different drive waveforms are used is required, and thus a large data area is necessary to store such LUTs. In Patent Documents 2 and 3, it is necessary to store data representing the length of a period (the period length register value) for each period during which the drive voltage is output, and thus a large data area is necessary to store such data.

Moreover, in Patent Documents 2 and 3, data such as the start and end periods of output of the drive voltage or the number of times of repetition must be held separately. In order to perform temperature compensation of the drive waveform, therefore, there arises a trouble of rewriting such data every time the temperature range changes. It may be possible to secure a data area where all data for the different temperature ranges is stored and select appropriate data according to a temperature range. This however raises a problem of further increasing the data area.

SUMMARY

A first advantage of some aspects of the invention is, in an integrated circuit device that sets drive waveforms used for drive of an electrooptic panel, or sets drive waveforms and drives the electrooptic panel, reducing the data area where data representing the length of a period during which a drive voltage is applied to the electrooptic panel is stored. A second advantage of some aspects of the invention is reducing the communication amount and the load on a host CPU, etc., as well as reducing the data area, by eliminating the necessity to rewrite waveform information in response to a change in environmental condition and also eliminating the necessity to store waveform information for each environmental condition even when the drive waveform is compensated in response to a change in environmental condition such as temperature. Furthermore, a third advantage of some aspects of the invention is providing an electronic apparatus equipped with such an integrated circuit device, and a control method for an electrooptic panel used in such an integrated circuit device and an electronic apparatus.

According to a first aspect of the invention, an integrated circuit device that sets a drive waveform for an electrooptic panel driven over a plurality of phases is provided. The device includes: a timing information storage section where phase length information representing a phase length for which a fixed drive voltage is applied to the electrooptic panel is stored in correspondence with an index number; a waveform information storage section where waveform information related to a plurality of drive waveforms used in response to at least one display state determined by display data is stored; a timing control section that reads an index number included for each phase in waveform information stored in the waveform information storage section, reads phase length information corresponding to the index number from the timing information storage section, and sequentially generates a selection signal during a drive voltage application period corresponding to a plurality of phases by counting a display timing clock signal in accordance with the phase length information; and a drive waveform selection section that selects a waveform value representing a drive voltage, out of a plurality of units of waveform information stored in the waveform information storage section, in accordance with the selection signal sequentially generated by the timing control section.

In the integrated circuit device according to the first aspect of the invention, by storing the phase length information in the timing information storage section in correspondence with the index number, it is only necessary to store the index number small in the number of bits, in place of the phase length information, for each phase in the waveform information storage section for setting the drive voltage application period. Thus, the data area in the integrated circuit device can be reduced. Moreover, in compensation of the drive waveform in response to a change in environmental condition such as temperature, also, it is only necessary to change or select phase length information stored in the timing information storage section. In the waveform information storage section, the same index number can be used in common for different environmental conditions. Thus, the communication amount and the load on the host CPU, etc. can be reduced, and also the data area in the integrated circuit device can be reduced.

The integrated circuit device described above may further include: a display data storage section that stores display data representing at least one display state of the electrooptic panel; and a drive voltage generation section that selects a waveform value representing a drive voltage to be applied to each electrode of the electrooptic panel, out of one set of waveform values selected by the drive waveform selection section, in response to display data stored in the display data storage section, and generate a drive voltage based on the selected waveform value. With this configuration, the drive voltage applied to each electrode of the electrooptic panel can be generated based on the set drive waveform.

In the integrated circuit device described above, the waveform information storage section may store waveform information related to a plurality of sets of drive waveforms in correspondence with a plurality of drive modes, and the drive waveform selection section may select one set of waveform values representing one set of drive voltages, out of waveform information related to one set of drive waveforms corresponding to a designated drive mode, in accordance with the selection signal sequentially generated by the timing control section. Since the phase length set based on the index number can be used in common for a plurality of drive modes, it is unnecessary to provide a storage area for phase length information for each drive mode. Thus, the data area in the integrated circuit device can be reduced.

In the integrated circuit device described above, the timing information storage section may further store frame time information representing the time of one frame, and the timing control section may include a clock frequency regulator circuit that regulates the frequency of the display timing clock signal in accordance with the frame time information stored in the timing information storage section. By combining the frame time information and the phase length information, the drive waveform can be flexibly set. Alternatively, by changing only the frame time information depending on the environmental condition, the drive waveform can be changed.

In the integrated circuit device described above, the waveform information storage section may store end phase position information specifying the position of a phase in which application of a drive voltage is terminated at the head of a storage area where waveform information related to one set of drive waveforms is stored, and the timing control section may stop generation of the selection signal after generating the selection signal during the drive voltage application period corresponding to a phase at the position specified by the end phase position information stored in the waveform information storage section. With this configuration, it becomes unnecessary to store bits representing the end position of the drive waveform in the storage area where waveform information for each phase is stored. Thus, the data amount stored in the waveform information storage section can be reduced.

In the integrated circuit device described above, the timing information storage section may store a plurality of kinds of timing information used under a plurality of different environmental conditions. With this configuration, it becomes unnecessary for the host CPU, etc. to send timing information again even when the environmental condition has changed.

The integrated circuit device described above may further include a control section that selects one kind of timing information, out of the plurality of kinds of timing information stored in the timing information storage section, depending on an environmental condition measured by an environmental condition sensor. With this configuration, the drive waveform for the electrooptic panel can be changed in response to a change in environmental condition automatically, not in accordance with an instruction from the host CPU 40, etc.

According to a second aspect of the invention, an electronic apparatus includes: an electrooptic panel; and any of the integrated circuit devices described above. Thus, it is possible to implement various electronic apparatuses having the electrooptic panel driven by the integrated circuit device where the data area, the communication amount, or the load on the host CPU is reduced.

According to a third aspect of the invention, a control method for an electrooptic panel in a plurality of phases is provided. The method includes: (a) storing display data representing at least one display state of the electrooptic panel in a display data storage section; (b) reading an index number included for each phase in a waveform information storage section that stores waveform information related to at least one set of drive waveforms used in response to at least one display state determined by display data; (c) reading phase length information corresponding to the index number read in step (b) from the timing information storage section that stores phase length information representing the phase length for which a fixed drive voltage is applied to the electrooptic panel in correspondence with an index number; (d) sequentially generating a selection signal during a drive voltage application period corresponding to a plurality of phases by counting a display timing clock signal in accordance with the phase length information read in step (c); (e) selecting one set of waveform values representing one set of drive voltages, out of waveform information stored in the waveform information storage section, in accordance with the selection signal sequentially generated in step (d); and (f) selecting a waveform value representing a drive voltage to be applied to each electrode of the electrooptic panel, out of one set of waveform values selected in step (e), in response to display data stored in the display data storage section, and generating a drive voltage based on the selected waveform value.

In the control method for an electrooptic panel according to the third aspect of the invention, by storing the phase length information in the timing information storage section in correspondence with the index number, it is only necessary to store the index number small in the number of bits, in place of the phase length information, for each phase in the waveform information storage section for setting the drive voltage application period. Thus, the data area in the timing information storage section and the waveform information storage section can be reduced. Moreover, in compensation of the drive waveform in response to a change in environmental condition such as temperature, also, it is only necessary to change or select phase length information stored in the timing information storage section. In the waveform information storage section, the same index number can be used in common for different environmental conditions. Thus, the communication amount and the load on the host CPU, etc. can be reduced, and also the data area in the timing information storage section and the waveform information storage section can be reduced.

BRIEF DESCRIPTION OF THE DRAWINGS

The invention will be described with reference to the accompanying drawings, wherein like numbers reference like elements.

FIGS. 5A to 5C are views showing the first setting example of drive waveforms in the first embodiment of the invention.

FIGS. 6A to 6C are views showing the first setting example of drive waveforms in the first embodiment of the invention.

FIGS. 7A to 7C are views showing the first setting example of drive waveforms in the first embodiment of the invention.

FIGS. 8A to 8C are views showing the second setting example of drive waveforms in the first embodiment of the invention.

FIGS. 9A to 9C are views showing the second setting example of drive waveforms in the first embodiment of the invention.

FIGS. 10A to 10C are views showing the second setting example of drive waveforms in the first embodiment of the invention.

FIGS. 11A to 11D are views showing the third setting example of drive waveforms in the first embodiment of the invention.

FIG. 14 is a view showing a setting example of drive waveforms in the second embodiment of the invention.

FIG. 15 is a view showing a setting example of drive waveforms in the third embodiment of the invention.

DESCRIPTION OF EXEMPLARY EMBODIMENTS

Figure 1:
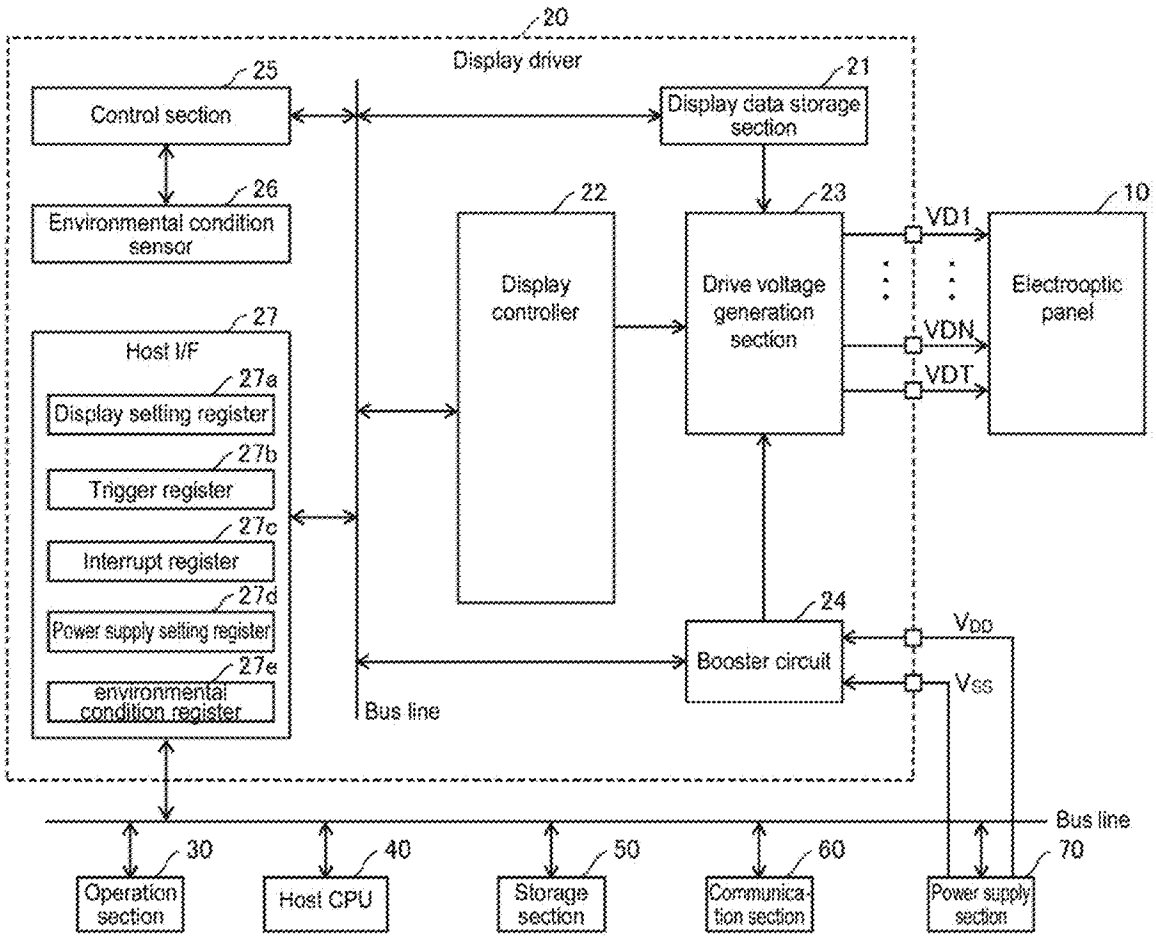
FIG. 1 is a block diagram showing an example configuration of an electronic apparatus according to the first embodiment of the invention.

Embodiments according to the invention will be described hereinafter in detail with reference to the accompanying drawings. Note that like components are denoted by like reference characters, and duplication of description is avoided.

Electronic Apparatus

FIG. 1 is a block diagram showing an example configuration of an electronic apparatus according to the first embodiment of the invention. According to the invention, various electronic apparatuses can be implemented, which include wristwatches, electronic books, electronic newspapers, electronic advertising signboards, guideboards, electronic cards (credit cards, point cards, etc.), remote controllers, cellular phones, PDAs, calculators, etc. FIG. 1 mainly shows a configuration allowing such an electronic apparatus to perform image display.

As shown in FIG. 1, the electronic apparatus includes an electrooptic panel 10 such as an electrophoretic display (EPD) panel, a display driver 20, an operation section 30, a host central processing unit (CPU) 40, a storage section 50, a communication section 60, and a power supply section 70.

The components from the display driver 20 to the power supply section 70 are connected to one another via a bus line.

The display driver 20 drives the electrooptic panel 10 to allow the electrooptic panel 10 to display an image. The operation section 30, including operation buttons, for example, is used for the user to input various instructions and information. The host CPU 40 controls the components of the electronic apparatus. The storage section 50, including a memory such as EEPROM or a hard disk as a memory medium, stores various kinds of information. The communication section 60, comprised of an analog circuit and a digital circuit, for example, performs communication with an external apparatus. The power supply section 70, comprised of an analog circuit, for example, supplies a power supply voltage to the components of the electronic apparatus.

The storage section 50 stores software for making the host CPU 40 to perform various types of processing. The storage section 50 also stores timing information for setting the time period during which each drive voltage is applied to the electrooptic panel 10 (drive voltage application period). The storage section 50 further stores waveform information related to at least one set of drive waveforms during the time until the display state of the electrooptic panel 10 changes from a first display state corresponding to first display data to a second display state corresponding to second display data. The host CPU 40 can supply the timing information and the waveform information stored in the storage section 50 and display data obtained by the communication section 60, etc. to the display driver 20.

Electrooptic Panel

As the electrooptic panel 10, an EPD panel is typically used, but an electrooptic panel, other than the EPD panel, of which the display state is controlled with the applied time of the drive voltage can also be used.

For example, as the electrooptic panel 10, an electrochromic display (ECD) panel can be used. The ECD panel has elements that change in color with the electric field, and performs display using a phenomenon that, when voltages are applied between the top plane electrode and the segment electrodes, color is given to the elements, or the light transmission of the elements changes, due to oxidation-reduction reaction.

Otherwise, a nanochromics display (NCD) panel may be used as the electrooptic panel 10. Other panels such as a QR-LPD (registered trademark) panel, a panel using cholesteric liquid crystal, a panel using chiral nematic liquid crystal, and an electro-wetting panel may also be used as the electrooptic panel 10.

Figure 2:
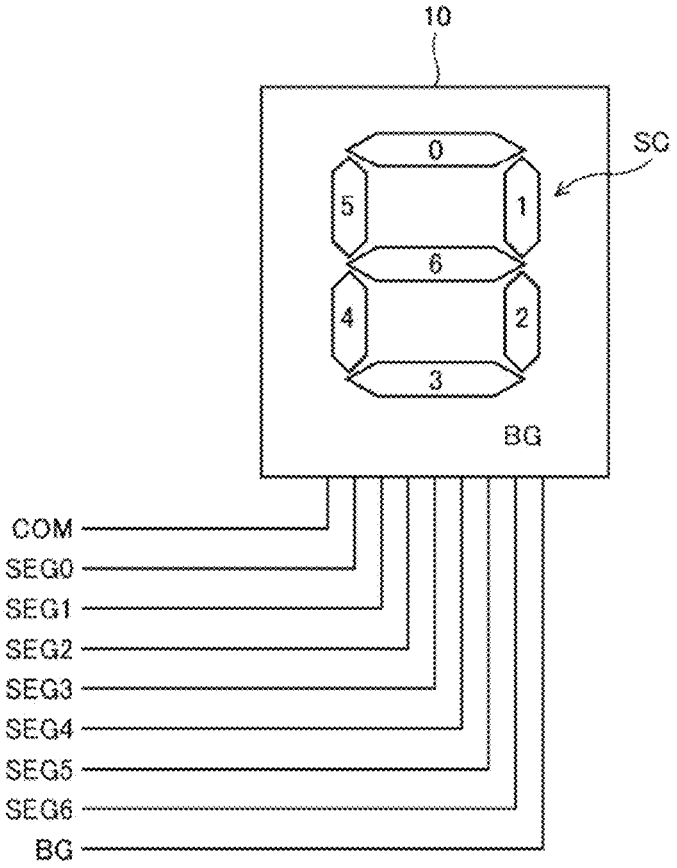
FIG. 2 is a plan view showing an EPD panel as an example of an electrooptic panel.

FIG. 2 is a plan view showing an EPD panel as an example of the electrooptic panel. In this example, the electrooptic panel 10 displays a character such as a numeral. The electrooptic panel 10 has a display body that displays one digit of a segment character SC comprised of seven segments 0 to 6. An area BG surrounding the segments 0 to 6 represents a background area of the segment character SC.

The electrooptic panel 10 in this example has one common top plane electrode COM, seven segment electrodes SEG0 to SEG6, and one back plane electrode BG. Nine lines coming out from the bottom of the electrooptic panel 10 are leads connected to these electrodes and are connected to the display driver 20 shown in FIG. 1. Note hereinafter that the back plane electrode BG will also be described as one type of segment electrode.

Figure 3:
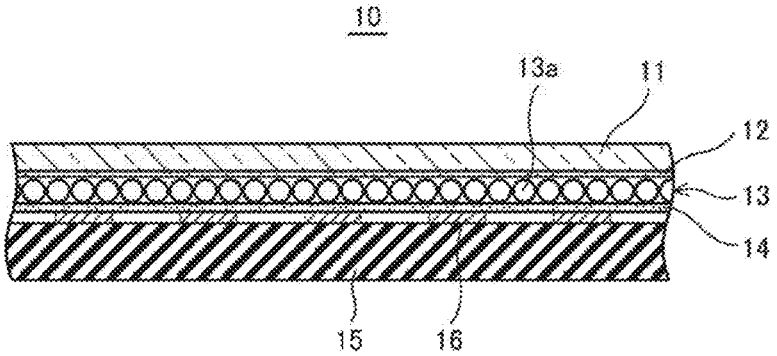
FIG. 3 is a cross-sectional view schematically showing part of an EPD panel as an example of an electrooptic panel.

FIG. 3 is a cross-sectional view schematically showing part of an EPD panel as an example of the electrooptic panel. As shown in FIG. 3, a transparent top plane electrode 12 such as an indium tin oxide (ITO) film is formed over the entire back surface of a transparent resin substrate 11 that is to be the display plane. An electrophoretic layer 13 is formed into a film under the top plane electrode 12. The film-like electrophoretic layer 13 is bonded, via an adhesive layer 14, to a flexible printed board 15 on the surface of which segment electrodes 16 are formed for pixels, to constitute the electrooptic panel 10.

In the electrophoretic layer 13, a number of minute microcapsules 13*a* having a diameter of several tens of micrometers are dispersed in a binder, a surfactant, a thickener, pure water, or a mixture thereof. The microcapsules 13*a* each have white particles made of titanium oxide, etc. and black particles made of carbon black, etc. sealed in a capsule shell made of a transparent methacrylic resin, etc. in a state dispersed in a transparent dispersion medium high in viscosity such as silicone oil. The white particles are negatively charged and the black particles are positively charged, for example.

When a voltage is applied between the top plane electrode 12 and a segment electrode 16, electrostatic force acts on positively-charged black particles and negatively-charged white particles sealed in microcapsules 13*a* in directions depending on the polarities of the charging. For example, when the segment electrode 16 is at a potential higher than the top plane electrode 12, the positively-charged black particles move toward the top plane electrode 12, resulting in that the pixel in question exhibits black display. When the segment electrode 16 is at a potential lower than the top plane electrode 12, the negatively-charged white particles move toward the top plane electrode 12, resulting in that the pixel in question exhibits white display.

The white particles and the black particles move in the dispersion medium by electrophoresis. The electrooptic panel 10 has a nonvolatile (memory) property where, after the display state is changed by applying a voltage between the top plane electrode 12 and a segment electrode 16, the display state is maintained even when the top plane electrode 12 and the segment electrode 16 are put in the same potential. Therefore, since it is only necessary to apply a drive voltage to the electrooptic panel 10 at the time of changing the display on the electrooptic panel 10, power consumption can be extremely low.

To drive the electrooptic panel 10, the potentials of the segment electrodes 16 may be changed while the potential of the top plane electrode 12 is fixed. In this case, for example, while the potential of the top plane electrode 12 is fixed to 0 V, a positive drive voltage is applied to segment electrodes 16 for pixels of which the display state is to be changed from white display to black display, a negative drive voltage is applied to segment electrodes 16 for pixels of which the display state is to be changed from black display to white display, and a drive voltage of 0 V is applied to segment electrodes 16 for pixels of which the display state is to be kept unchanged.

Alternatively, both the potential of the top plane electrode 12 and the potentials of the segment electrodes 16 may be changed. In this case, for example, while a drive voltage of 0 V is being applied to the top plane electrode 12, a positive drive voltage is applied to segment electrodes 16 for pixels of which the display state is to be changed from white display to black display, and a drive voltage of 0 V is applied to segment electrodes 16 for pixels of which the display state is to be kept unchanged. While a positive drive voltage is being applied to the top plane electrode 12, a drive voltage of 0 V is applied to segment electrodes 16 for pixels of which the display state is to be changed from black display to while display, and the same drive voltage as that to the top plane electrode 12 is applied to segment electrodes 16 for pixels of which the display state is to be kept unchanged. The latter case will be described in this embodiment.

Also, the display state is stabilized by changing the voltages applied between the top plane electrode 12 and the segment electrodes 16 in accordance with drive waveforms during the time period until the display state of the electrooptic panel 10 changes from the first display state corresponding to the first display data to the second display state corresponding to the second display data. Therefore, the electrooptic panel 10 is driven with a series of drive voltages over a plurality of phases.

The "phase" as used herein refers to a time period of a drive waveform for the electrooptic panel 10 during which the drive voltage is fixed. In other words, the "phase" refers to a time period during which the waveform value is fixed. Note herein that a voltage change due to a leakage occurring during the time from a halt of the power supply circuit until restart of power supply is considered falling within the definition "the drive voltage is fixed." The "phase length" that is the length of the phase represents the number of cycles of a display timing clock signal. For example, the phase length of "four" represents four cycles of the display timing clock signal. Note herein that one cycle of the display timing clock signal corresponds to the time of one frame.

Display Driver

Referring back to FIG. 1, the display driver 20 includes a display data storage section 21, a display controller 22, a drive voltage generation section 23, a booster circuit 24, a control section 25, an environmental condition sensor 26, and a host interface (I/F) 27. The display data storage section 21, the display controller 22, the booster circuit 24, the control section 25, and the host interface 27 are connected to one another via a bus line. The integrated circuit device according to an embodiment of the invention includes the display controller 22, and may further include at least some of the display data storage section 21, the drive voltage generation section 23, the booster circuit 24, the control section 25, the environmental condition sensor 26, and the host interface 27.

The display data storage section 21 stores display data supplied from the host CPU 40 via the host interface 27, for example. It is desirable for the electrooptic panel 10 to stabilize the display state by changing the voltages applied between all the segment electrodes and the top plane electrode in accordance with a predetermined rule during the time period until the display state (gradation) in one segment electrode changes from the first display state corresponding to the first display data to the second display state corresponding to the second display data. For this reason, the electrodes of the electrooptic panel 10 are driven with a series of drive voltages over a plurality of phases.

The display controller 22, comprised of digital circuits and analog circuits, for example, sets a drive waveform for the electrooptic panel 10 driven with a series of drive voltages over a plurality of phases based on timing information and waveform information supplied from the host CPU 40 via the host interface 27. That is, the display controller 22 has a function of generating sequential drive waveforms required at the time of display change of the electrooptic panel 10. The timing information and waveform information required for generation of drive waveforms are stored in a programmable storage section, and the function of generating drive waveforms is implemented based on the timing information and waveform information stored in the programmable storage section.

To achieve the above, the display controller 22 generates the display timing clock signal, and also generates a display start trigger signal based on a display start command sent from the host CPU 40, to activate a display start flag in synchronization with the display timing clock signal. Further, when the display start flag is activated, the display controller 22 sequentially selects one set of waveform values stored in the storage section to set drive waveforms. In this way, the display controller 22 supplies one set of waveform values representing one set of drive voltages to the drive voltage generation section 23 during a drive voltage application period corresponding to each phase during the time period until the display state of the electrooptical panel 10 changes from the first display state to the second display state.

The drive voltage generation section 23, having a plurality of channels of circuits, generates drive voltages VD1 to VDN to be supplied to N segment electrodes (N≥2) of the electrooptic panel 10 based on one set of waveform values supplied from the display controller 22 and display data stored in the display data storage section 21, and, when binary drive is performed for the electrooptic panel 10, generates a drive voltage VDT to be supplied to the top plane electrode of the electrooptic panel 10.

The booster circuit 24 boosts the power supply potential supplied from the power supply section 70, to generate at least one boosted power supply potential to be used in the drive voltage generation section 23. For example, when 0 V/15 V binary drive is performed for the electrooptic panel 10, the booster circuit 24 boosts the power supply potential $V_{DD}$ (e.g., 1.8 V to 5.5 V) supplied from the power supply section 70 with respect to the power supply potential $V_{SS}$ (e.g., 0 V), to obtain a boosted power supply potential (15 V).

The control section 25, comprised of digital circuits, for example, controls the components of the display driver 20. When the control section 25 includes a central processing unit (CPU), the integrated circuit device including the control section 25 may be configured as a microcontroller unit (MCU).

The environmental condition sensor 26 measures an environmental condition such as the temperature, the humidity, and the atmospheric pressure under the control of the control section 25. The reason for this provision is that the display characteristics of the electrooptic panel may change with such environmental conditions. The environmental condition sensor 26 can be attached to the back surface of the flexible printed board 15 (FIG. 3). As the environmental condition sensor 26, a thermocouple or a temperature sensor may be embedded in the electrophoretic layer 13 (FIG. 3) or placed next to the electrophoretic layer 13.

The host interface 27, comprised of digital circuits, for example, performs interface processing between the display driver 20 and the host CPU 40. The host interface 27 has control registers such as a display setting register 27*a*, a trigger register 27*b*, an interrupt register 27*c*, a power supply setting register 27*d*, and an environmental condition register 27*e*. The host CPU 40 can access these control registers to store control information in the control registers and read control information and measurement information from the control registers.

The display setting register 27*a* stores instructions of setting of a clock signal and the display timing clock signal generated in the display controller 22, instructions of reversed display, all black display, and all white display in the electrooptic panel 10, etc. The trigger register 27*b* stores the display start trigger signal for starting the drive waveform generation operation.

The interrupt register 27*c* stores interrupt flags and interrupt masks that occur after termination of the drive waveform generation operation. The power supply setting register 27*d* stores various kinds of control information such as instructions of ON/OFF of the booster circuit 24, setting of a constant voltage circuit (regulator), setting of the boosting multiplicative factor, fine adjustment of the boosted voltage (contrast, trimming), etc. The environmental condition register 27*e* stores flags representing the measurement results of the environmental condition sensor 26.

First Embodiment

Figure 4:
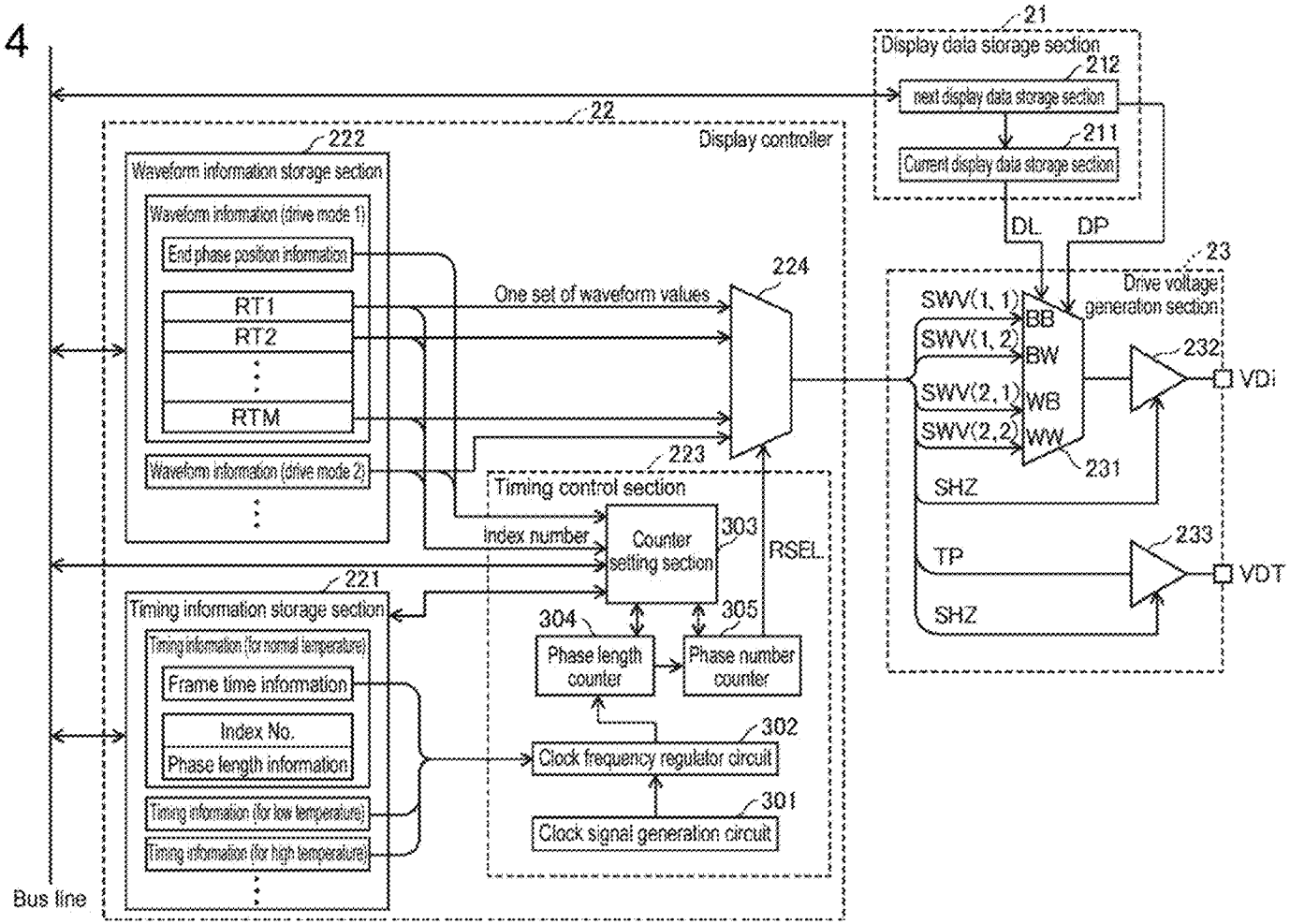
FIG. 4 is a view showing in detail part of a configuration of a display driver shown in FIG. 1.

FIG. 4 is a view showing in detail part of the configuration of the display driver shown in FIG. 1. In FIG. 4, detailed configurations of the display data storage section 21, the display controller 22, and the drive voltage generation section 23 are shown.

The display data storage section 21 is comprised of a register including a plurality of flipflops or a memory such as SRAM, for example. The display data storage section 21 may include a current display data storage section 211 that stores the first display data (current display data) DL supplied from the host CPU 40 (FIG. 1) and a next display data storage section 212 that stores the second display data (next display data) DP supplied next to the first display data DL.

For example, in the case that the display driver 20 outputs 256 drive voltages to 256 segment electrodes of the electrooptic panel, display data including 256 units of segment display data is supplied to the next display data storage section 212. The display data storage section 21 updates the first display data DL and the second display data DP when new display data is supplied.

The display controller 22 includes a timing information storage section 221, a waveform information storage section 222, a timing control section 223, and a drive waveform selection section 224. The timing information storage section 221 and the waveform information storage section 222 are each comprised of a nonvolatile memory or a register, and may be formed integrally. The timing information storage section 221 and the waveform information storage section 222 respectively store timing information and waveform information supplied from the host CPU 40 (FIG. 1), for example.

The timing information storage section 221 stores phase length information representing the phase length for which a fixed drive voltage is applied to the electrooptic panel in correspondence with an index number. The timing information storage section 221 may store one kind of timing information including an index number and phase length information.

Alternatively, as illustrated in FIG. 4, the timing information storage section 221 may store a plurality of kinds of timing information used under a plurality of different environmental conditions (e.g., for normal temperature, for low temperature, and for high temperature). This case eliminates the necessity for the host CPU 40 to send timing information again to the display controller 22 even when the environmental condition has changed.

Moreover, the timing information storage section 221 may store frame time information representing the time of one frame. The frame time information is supplied from the host CPU 40 (FIG. 1), for example. By combining the frame time information and the phase length information, the drive waveform can be flexibly set depending on the environmental condition such as the temperature. Alternatively, by changing only the frame time information, the drive waveform can be changed depending on the environmental condition.

When it is unnecessary to change the waveform information even though the environmental condition has changed, the host CPU 40 can suspend the sending operation after having sent the frame time information, or the index number and the phase length information, to the display controller 22 to change the setting. Thus, the change of the drive waveforms in response to a change in environmental condition can be performed with the minimum data rewrite without involving sending of waveform information.

The waveform information storage section 222 stores waveform information related to at least one set of drive waveforms used in response to at least one display state determined by display data. The at least one display state as used herein may be the display state corresponding to the first display data DL and the display state corresponding to the second display data DP, or the display state corresponding to the display data DP. In the drive voltage generation section 23, one drive waveform is to be selected from the set of drive waveforms in response to actually supplied display data.

The at least one set of drive waveforms as used herein may be one set of drive waveforms in one drive mode, or may include one set of drive waveforms in drive mode 1 and one set of drive waveforms in drive mode 2, as illustrated in FIG. 4. Drive mode 1 is a high-speed mode shorter than drive mode 2, in the time required for the change from the display state corresponding to the first display data DL to the display state corresponding to the second display data DP, for example. Drive mode 2 is a low-ghost mode that is lower in rewrite speed than drive mode 1, but has reduced ghost, i.e., performs high-quality rewrite. By being designated by the host CPU 40 (FIG. 1), etc., one drive mode is selected out of a plurality of drive modes.

The waveform information storage section 222 has storage areas RT1 to RTM respectively storing waveform information during periods T1 to TM corresponding to a plurality of phases for each drive mode. The waveform information for each phase for one drive mode includes one set of waveform values representing one set of drive voltages and an index number specifying the phase length.

Information for stopping generation of drive waveforms may be included in the waveform information for each phase. Alternatively, as illustrated in FIG. 4, the waveform information storage section 222 may store end phase position information specifying the position of the phase in which application of the drive voltage is terminated at the head of a storage area that stores waveform information related to one set of drive waveforms. This eliminates the necessity to store a bit representing the end position of the drive waveform (e.g., a bit representing whether or not the phase in question is the final phase) in the storage area that stores waveform information for each phase, permitting reduction in the data amount stored in the waveform information storage section 222.

After having sent the end phase position information and waveform information for only necessary phases to the display controller 22 to make setting, the host CPU 40 (FIG. 1) can suspend the sending operation to reduce the communication amount and the load since it is no more necessary to send waveform information for phases subsequent to the end phase.

The display controller 22 can also suspend the receiving operation at the time of completion of reception of the waveform information for necessary phases based on the end phase position information. For example, when the end phase position information indicates the fifth phase, the receiver circuit can be powered down at the time of completion of reception of waveform information for the fifth phase. This can reduce the power consumption of the display controller 22.

The timing control section 223 reads an index number included for each phase in the waveform information stored in the waveform information storage section 222, reads phase length information corresponding to the index number from the timing information storage section 221, and counts the display timing clock signal in accordance with the phase length information, thereby sequentially generating a selection signal RSEL during the drive voltage application period corresponding to a plurality of phases.

When a plurality of kinds of timing information are stored in the timing information storage section 221, the control section 25 shown in FIG. 1 selects one kind of timing information, out of the plurality of kinds of timing information stored in the timing information storage section 221, in accordance with the environmental condition measured by the environmental condition sensor 26. Thus, the drive waveforms for the electrooptic panel can be changed in response to a change in environmental condition automatically, not in accordance with an instruction from the host CPU 40, etc.

The timing control section 223 includes a clock signal generation circuit 301, a clock frequency regulator circuit 302, a counter setting section 303, a phase length counter 304, and a phase number counter 305, for example. The clock signal generation circuit 301, comprised of a crystal oscillator, etc., generates the clock signal.

The clock frequency regulator circuit 302, comprised of a PLL circuit or a frequency divider circuit, generates the display timing clock signal based on the clock signal generated by the clock signal generation circuit 301. When frame time information is stored in the timing information storage section 221, the clock frequency regulator circuit 302 can regulate the frequency of the display timing clock signal in accordance with the frame time information.

The counter setting section 303 reads the end phase position information included in the waveform information stored in the waveform information storage section 222, and sets the phase number at the position specified by the end phase position information in the phase number counter 305. Also, the counter setting section 303 reads the index number included for each phase in the waveform information stored in the waveform information storage section 222, reads the phase length information corresponding to the index number from the timing information storage section 221, and sets the phase length represented by the phase length information in the phase length counter 304. At the time of start of display updating, the counter setting section 303 starts the counting operation of the phase length counter 304 and the phase number counter 305.

The phase length counter 304 increments the count value by counting the display timing clock signal, and activates its output signal once the count value becomes equal to the phase length set by the counter setting section 303. The time period from the start of the counting operation by the phase length counter 304 until the activation of the output signal represents the phase time (drive voltage application period) corresponding to the phase in question.

When the phase length counter 304 activates the output signal, the counter setting section 303 resets the count value of the phase length counter 304, setting the count value to zero and inactivating the output signal. Thereafter, the counter setting section 303 sets the phase length of the next phase in the phase length counter 304, and the phase length counter 304 starts counting of the display timing clock signal in the next phase.

The phase number counter 305 increments the count value by counting the output signal of the phase length counter 304, and outputs the count value representing the phase number as the selection signal RSEL in the drive voltage application period corresponding to a plurality of phases. Once the counter value of the phase number counter 305 exceeds the phase number set by the counter setting section 303, the counter setting section 303 resets the count value of the phase number counter 305, setting the count value to zero. Thus, the timing control section 223 can stop generation of the selection signal RSEL after having generated the selection signal RSEL during the drive voltage application period corresponding to the phase at the position specified by the end phase position information stored in the waveform information storage section 222.

The drive waveform selection section 224 selects one set of waveform values representing one set of drive voltages, out of the waveform information stored in the storage areas RT1 to RTM of the waveform information storage section 222, in accordance with the selection signal RSEL sequentially generated by the timing control section 223.

As shown in FIG. 4, when the waveform information storage section 222 stores waveform information related to a plurality of sets of drive waveforms in correspondence with a plurality of drive modes, the drive waveform selection section 224 selects one set of waveform values representing one set of drive voltages, out of waveform information related to one set of drive waveforms corresponding to the drive mode designated by the host CPU (FIG. 1), etc., in accordance with the selection signal RSEL. In this case, since the phase length set based on the index number can be used in common for a plurality of drive modes, it is unnecessary to provide a storage area for phase length information for each drive mode. Thus, the data area in the integrated circuit device can be reduced.

The drive waveform selection section 224 selects one set of waveform values stored in the storage area RT1 for use in the drive during the period T1, and then selects one set of waveform values stored in the storage area RT2 for use in the drive during the period T2, in accordance with the selection signal RSEL. This also applies to the periods T3 to TM.

Thus, the drive waveform selection section 224 outputs one set of drive waveform signals representing one set of drive waveforms during the time until the display state of pixels of the electrooptic panel changes from the first display state to the second display state. For example, the drive waveform selection section 224 generates segment signals SWV(1,1) to SWV(L,L) and a top plane signal TP, where L represents the number of gradations of the display data and is an integer equal to or more than 2. As an example, a case of L=2 will be described hereinafter.

When the number of gradations of the display data is 2, there are two states of black display and white display as the first display state corresponding to the first display data DL, and two states of black display and white display as the second display state corresponding to the second display data DP. The segment signal SWV(1,1) represents a drive waveform supplied to a segment electrode when the first and second display states are both black display. The segment signal SWV(1,2) represents a drive waveform supplied to a segment electrode when the first display state is black display and the second display state is white display.

Likewise, the segment signal SWV(2,1) represents a drive waveform supplied to a segment electrode when the first display state is white display and the second display state is black display. The segment signal SWV(2,2) represents a drive waveform supplied to a segment electrode when the first and second display states are both white display. The top plane signal TP represents a drive waveform supplied to the top plane electrode.

Moreover, one set of waveform values output from the drive waveform selection section 224 may include a waveform value for setting an output terminal of the drive voltage generation section 23 to a floating state (high impedance state). When the output terminal of the drive voltage generation section 23 is set to a floating state during the k-th period Tk ($1 \leq k \leq M$), a floating state setting bit of the k-th waveform value is set to "1." By this setting, a floating state setting signal SHZ is activated during the period Tk.

In the manner described above, the ON/OFF of the drive of the plurality of segment electrodes and the top plane electrode of the electrooptic panel can be controlled. The reason why such an ON/OFF control function is provided is that not only a specific drive voltage but also a floating state may sometimes be required in a course of the drive sequence depending on the type of the electrooptic panel.

The drive voltage generation section 23 selects a waveform value representing a drive voltage to be applied to each electrode of the electrooptic panel, out of one set of waveform values selected by the drive waveform selection section 224, in response to the display data stored in the display data storage section 21, and generates a drive voltage based on the selected waveform value. In this way, a drive voltage to be applied to each electrode of the electrooptic panel can be generated based on the set drive waveform.

For example, the drive voltage generation section 23 selects one waveform value, out of the waveform values of the segment signals SWV(1,1) to SWV(2,2) supplied from the drive waveform selection section 224, based on the first display data DL and the second display data DP supplied from the display data storage section 21, and generates a drive voltage VDi to be supplied to the i-th segment electrode of the electrooptic panel based on the selected waveform value. Also, the drive voltage generation section 23 generates a drive voltage VDT to be supplied to the top plane electrode of the electrooptic panel based on the waveform value of the top plane signal TP supplied from the drive waveform selection section 224.

The drive voltage generation section 23 includes a selector 231 and a drive circuit 232 in a circuit of one channel for driving each segment electrode. Also, the drive voltage generation section 23 includes a drive circuit 233 in a circuit for driving the top plane electrode. The drive circuits 232 and 233 are each comprised of an analog circuit, for example.

The selector 231 selects one waveform value, out of one set of waveform values supplied from the drive waveform selection section 224, based on the first display data DL and the second display data DP supplied from the display data storage section 21, and outputs the selected waveform value to the drive circuit 232. The drive circuit 232 shifts the level of the waveform value using at least one boosted power supply potential supplied from the booster circuit 24 (FIG. 1), to generate the drive voltage VDi.

The drive circuit 232 can also put the output terminal in a floating state in accordance with the floating state setting signal SHZ. The drive circuit 232 outputs the drive voltage VDi from the output terminal when the floating state setting signal SHZ is inactive, and puts the output terminal in a floating state when the floating state setting signal SHZ is activated.

The drive circuit 233 shifts the level of the waveform value supplied from the drive waveform selection section 224 using at least one boosted power supply potential supplied from the booster circuit 24 (FIG. 1), to generate the drive voltage VDT. The drive circuit 233 can also put an output terminal PDT (not shown) in a floating state in accordance with the floating state setting signal SHZ. The drive circuit 233 outputs the drive voltage VDT from the output terminal PDT when the floating state setting signal SHZ is inactive, and puts the output terminal PDT in a floating state when the floating state setting signal SHZ is activated.

First Setting Example of Drive Waveforms

FIGS. 5A-5C to 7A-7C are views showing the first setting example of drive waveforms according to the first embodiment of the invention. In the first setting example, two kinds of phase lengths are used. For example, the host CPU 40 shown in FIG. 1 sets timing information in the display controller 22 depending on the temperature measured by the environmental condition sensor 26. Alternatively, the host CPU 40 can set fixed waveform information in the display controller 22 independently of any environmental condition such as the temperature.

The timing information shown in FIGS. 5A to 5C is one used when the temperature T is 20° C., and may be applied to a temperature range of 10° C.<T≤30° C. (normal temperature), for example. FIG. 5A shows timing information stored in the timing information storage section 221 of the display controller 22 shown in FIG. 4 and the corresponding phase time.

The "phase time" as used herein is equivalent to the drive voltage application time determined by the product of the frame time and the phase length. The timing information storage section 221 stores "40" indicating 40 ms as the frame time information. The timing information storage section 221 also stores phase length information representing the phase length for which a fixed drive voltage is applied to the electrooptic panel, in correspondence with the index number.

For example, since a phase length of "1" is set in correspondence with index number "0," when index number "0" is designated in the waveform information, the phase length will be "1" and the phase time will be 40 ms. Also, since a phase length of "4" is set in correspondence with index number "1," when index number "1" is designated in the waveform information, the phase length will be "4" and the phase time will be 160 ms.

FIG. 5B shows waveform information stored in the waveform information storage section 222 of the display controller 22 shown in FIG. 4, as well as the phase length, the phase time, etc. corresponding to this information, in drive mode 1 (high-speed mode). FIG. 5C shows waveform information stored in the waveform information storage section 222 shown in FIG. 4, as well as the phase length, the phase time, etc. corresponding to this information, in drive mode 2 (low-ghost mode). Although the frame number and the phase number are shown in FIGS. 5B and 5C to clarify the relationship between the frame and the phase, these numbers do not constitute the waveform information and are not stored in the waveform information storage section 222.

The "TP" represents the waveform value of the top plane signal. The "BB," "BW,", "WB," and "WW" represent the waveform values of the segment signals, which respectively correspond to the segment signals SWV(1,1), SWV(1,2), SWV(2,1), and SWV(2,2). For example, the waveform value "0" represents a drive voltage of 0 V, and the waveform value "1" represents a drive voltage of 15 V.

The waveform information storage section 222 stores the waveform values TP, BB, BW, WB, and WW and the index number for each phase. The counter setting section 303 of the timing control section 223 can read the phase length by referring to the timing information storage section 221 based on the index number designated in the waveform information stored in the waveform information storage section 222. Further, the phase time is determined by the product of the frame time and the phase length. Thus, flexible waveforms can be generated by the combination of the frame time and the phase length.

Referring to FIG. 5B, changes in display state in drive mode 1 will be described. In the first phase (phase number 0), 15 V is applied to the top plane electrode. For the segment of which the first display state is black and the second display state is to be white, 0 V is applied to the segment electrode, causing a transition of the display state to white. For the other segments, the same voltage, 15 V, as that to the top plane electrode is applied to the segment electrodes, causing no change in display state.

Thereafter, in the second phase (phase number 1), 0 V is applied to the top plane electrode. For the segment of which the first display state is white and the second display state is to be black, 15 V is applied to the segment electrode, causing a transition of the display state to black. For the other segments, the same voltage, 0 V, as that to the top plane electrode is applied to the segment electrodes, causing no change in display state. In this way, in drive mode 1, the display state is changed by applying an electric field to only a segment of which the first display state is different from the second display state.

Next, referring to FIG. 5C, changes in display state in drive mode 2 will be described. In the first phase, 0 V is applied to the top plane electrode. For the segments of which the first display state is black, 0 V is applied to the segment electrodes, causing no change in display state. For the segments of which the first display state is white, 15 V is applied to the segment electrodes, changing the display state to black. That is, at this time, all the segments exhibit black display.

In the second phase, 15 V is applied to the top plane electrode, and 0 V is applied to the segment electrodes of all the segments, changing the display state to white. That is, at this time, all the segments exhibit white display. In the third phase, 0 V is applied to the top plane electrode. For the segments of which the second display state is black, 15 V is applied to the segment electrodes, changing the display state to black. For the segments of which the second display state is white, 0 V is applied to the segment electrodes, causing no change in display state.

The last phase in the FIGS. 5B and 5C is the end phase for releasing the charge by applying no bias between the top plane electrode and the segment electrodes, and is made shorter than the phases for which a bias voltage is applied between the top plane electrode and the segment electrodes. By this setting, the boosting operation by the booster circuit 24 (FIG. 1) can be stopped soon, to achieve reduction in power consumption.

The waveform information storage section 222 may store end phase position information representing phase number "2" of the end phase, in addition to the waveform information shown in FIG. 5B, as the waveform information for the drive mode 1, and store end phase position information representing phase number "3" of the end phase, in addition to the waveform information shown in FIG. 5C, as the waveform information for drive mode 2.

As shown in FIGS. 5A to 5C, when the index number is made of three bits, and the phase length is made of eight bits, a phase length up to 255 at maximum can be set based on the 3-bit index number. In this way, using the index number in place of the phase length information in the waveform information, the data area required in the display controller 22 can be reduced. In the setting example shown in FIGS. 5B and 5C, however, where only "0" and "1" are used as the index number, the index number may be made of one bit.

Since the phase length set in the timing information is used in common for a plurality of drive modes, the communication amount between the host CPU 40 and the display controller 22 shown in FIG. 1 and the load on the host CPU 40 can be reduced. Also, with no need to provide a storage area for phase length information for each drive mode, the data area required in the display controller 22 can be reduced.

The timing information shown in FIGS. 6A to 6C is one used when the temperature T is 0° C., and may be applied to a temperature range of T≤10° C. (lower temperature than in FIG. 5A), for example. FIG. 6A shows timing information stored in the timing information storage section 221 of the display controller 22 shown in FIG. 4 and the corresponding phase time.

As shown in FIG. 6A, "80" indicating 80 ms is set as the frame time information. For example, since a phase length of "1" is set in correspondence with index number "0," when index number "0" is designated in the waveform information, the phase length will be "1" and the phase time will be 80 ms. Also, since a phase length of "25" is set in correspondence with index number "1," when index number "1" is designated in the waveform information, the phase length will be "25" and the phase time will be 2000 ms.

As described above, by setting the frame time and the phase length in the timing information to be longer than those in FIG. 5A, the phase time can be made longer. Alternatively, by setting either the frame time or the phase length in the timing information to be longer than that in FIG. 5A, the product of the phase time and the phase length can be made larger than that in FIG. 5A, to make the phase time longer.

FIG. 6B shows waveform information stored in the waveform information storage section 222 of the display controller 22 shown in FIG. 4, as well as the phase length, the phase time, etc. corresponding to the waveform information, in drive mode 1 (high-speed mode). FIG. 6C shows waveform information stored in the waveform information storage section 222 shown in FIG. 4, as well as the phase length, the phase time, etc. corresponding to the waveform information, in drive mode 2 (low-ghost mode). Since the same waveform information as that shown in FIGS. 5B and 5C can be used, it is unnecessary for the host CPU (FIG. 1) to change the waveform information. The phase length and the phase time can be changed by changing the timing information.

The timing information shown in FIGS. 7A to 7C is one used when the temperature T is 50° C., and may be applied to a temperature range of T>30° C. (higher temperature than in FIG. 5A), for example. FIG. 7A shows timing information stored in the timing information storage section 221 of the display controller 22 shown in FIG. 4 and the corresponding phase time.

As shown in FIG. 7A, "20" indicating 20 ms is set as the frame time information. For example, since a phase length of "1" is set in correspondence with index number "0," when index number "0" is designated in the waveform information, the phase length will be "1" and the phase time will be 20 ms. Also, since a phase length of "5" is set in correspondence with index number "1," when index number "1" is designated in the waveform information, the phase length will be "5" and the phase time will be 100 ms. In this way, by setting the frame time in the timing information to be shorter than that in FIG. 5, the phase time can be made shorter.

FIG. 7B shows waveform information stored in the waveform information storage section 222 of the display controller 22 shown in FIG. 4, as well as the phase length, the phase time, etc. corresponding to the waveform information, in drive mode 1 (high-speed mode). FIG. 7C shows waveform information stored in the waveform information storage section 222 shown in FIG. 4, as well as the phase length, the phase time, etc. corresponding to the waveform information, in drive mode 2 (low-ghost mode). Since the same waveform information as that shown in FIGS. 5B and 5C can be used, it is unnecessary for the host CPU (FIG. 1) to change the waveform information. The phase length and the phase time can be changed by changing the timing information.

Second Setting Example of Drive Waveforms

FIGS. 8A to 8C to 10A to 10C are views showing the second setting example of drive waveforms according to the first embodiment of the invention. The second setting example is similar to the first setting example except for that three different phase lengths are used. The second setting example can be used for multi-gradation, color display, stirring of electrophoretic particles before rewrite, etc.

The timing information shown in FIGS. 8A to 8C is one used when the temperature T is 20° C., and may be applied to a temperature range of 10° C.<T≤30° C. (normal temperature), for example. FIG. 8A shows timing information stored in the timing information storage section 221 of the display controller 22 shown in FIG. 4 and the corresponding phase time. The timing information storage section 221 stores "40" indicating 40 ms as the frame time information. Also, the timing information storage section 221 stores the phase length information representing the phase length for which a fixed drive voltage is applied to the electrooptic panel in correspondence with the index number.

For example, since a phase length of "1" is set in correspondence with index number "0," when index number "0" is designated in the waveform information, the phase length will be "1" and the phase time will be 40 ms. Also, since a phase length of "4" is set in correspondence with index number "1," when index number "1" is designated in the waveform information, the phase length will be "4" and the phase time will be 160 ms. Further, since a phase length of "2" is set in correspondence with index number "2," when index number "2" is designated in the waveform information, the phase length will be "2" and the phase time will be 80 ms.

FIG. 8B shows waveform information stored in the waveform information storage section 222 of the display controller 22 shown in FIG. 4, as well as the phase length, the phase time, etc. corresponding to the waveform information, in drive mode 1 (high-speed mode). FIG. 8C shows waveform information stored in the waveform information storage section 222 shown in FIG. 4, as well as the phase length, the phase time, etc. corresponding to the waveform information, in drive mode 2 (low-ghost mode). FIG. 8B is the same as FIG. 5B described above. The phases of phase numbers 0 and 5 to 7 shown in FIG. 8C respectively correspond with the phases of phase numbers 0 to 3 shown in FIG. 5C described above.

In the phases of phase numbers 1 to 4 shown in FIG. 8C (frame numbers 5 to 12), in order to stir the electrophoretic particles to reduce the ghost, the electric field is reversed with a period shorter than the phase length "4" of the phases of phase numbers 0, 5, and 6, to reciprocate the electrophoretic particles. To achieve this, index number "2" representing a phase length of "2" is used. In the second setting example, the index number is made of two bits since "0," "1," and "2" are used as the index number.

The timing information shown in FIGS. 9A to 9C is one used when the temperature T is 0° C., and may be applied to a temperature range of T≤10° C. (lower temperature than in FIG. 8A), for example. FIG. 9A shows timing information stored in the timing information storage section 221 of the display controller 22 shown in FIG. 4 and the corresponding phase time.

As shown in FIG. 9A, "80" indicating 80 ms is set as the frame time information. For example, since a phase length of "1" is set in correspondence with index number "0," when index number "0" is designated in the waveform information, the phase length will be "1" and the phase time will be 80 ms. Also, since a phase length of "25" is set in correspondence with index number "1," when index number "1" is designated in the waveform information, the phase length will be "25" and the phase time will be 2000 ms. Further, since a phase length of "12" is set in correspondence with index number "2," when index number "2" is designated in the waveform information, the phase length will be "12" and the phase time will be 960 ms. In this way, by setting the frame time or the phase length in the timing information to be longer than that in FIG. 8A, the phase time can be made longer.

FIG. 9B shows waveform information stored in the waveform information storage section 222 of the display controller 22 shown in FIG. 4, as well as the phase length, the phase time, etc. corresponding to the waveform information, in drive mode 1 (high-speed mode). FIG. 9C shows waveform information stored in the waveform information storage section 222 shown in FIG. 4, as well as the phase length, the phase time, etc. corresponding to the waveform information, in drive mode 2 (low-ghost mode). Since the same waveform information as that shown in FIGS. 8B and 8C can be used, it is unnecessary for the host CPU 40 (FIG. 1) to change the waveform information. The phase length and the phase time can be changed by changing the timing information.

The timing information shown in FIGS. 10A to 10C is one used when the temperature T is 50° C., and may be applied to a temperature range of T>30° C. (higher temperature than in FIG. 8A), for example. FIG. 10A shows timing information stored in the timing information storage section 221 of the display controller 22 shown in FIG. 4 and the corresponding phase time.

As shown in FIG. 10A, "20" indicating 20 ms is set as the frame time information. For example, since a phase length "1" is set in correspondence with index number "0," when index number "0" is designated in the waveform information, the phase length will be "1" and the phase time will be 20 ms. Also, since a phase length of "5" is set in correspondence with index number "1," when index number "1" is designated in the waveform information, the phase length will be "5" and the phase time will be 100 ms. Further, since a phase length of "2" is set in correspondence with index number "2," when index number "2" is designated in the waveform information, the phase length will be "2" and the phase time will be 40 ms. In this way, by setting the frame time in the timing information to be shorter than that in FIGS. 8B and 8C, the phase time can be made shorter.

FIG. 10B shows waveform information stored in the waveform information storage section 222 of the display controller 22 shown in FIG. 4, as well as the phase length, the phase time, etc. corresponding to the waveform information, in drive mode 1 (high-speed mode). FIG. 100 shows waveform information stored in the waveform information storage section 222 shown in FIG. 4, as well as the phase length, the phase time, etc. corresponding to the waveform information, in drive mode 2 (low-ghost mode). Since the same waveform information as that shown in FIGS. 8B and 8C can be used, it is unnecessary for the host CPU 40 (FIG. 1) to change the waveform information. The phase time can be changed by changing the timing information.

Third Setting Example of Drive Waveforms

FIGS. 11A to 11D are views showing the third setting example of drive waveforms according to the first embodiment of the invention. FIG. 11A shows timing information stored in the timing information storage section 221 of the display controller 22 shown in FIG. 4 and the corresponding phase time. As shown in FIG. 11A, in the third setting example, "0" can be used as the phase length. In FIGS. 11A to 11D, index number "0" corresponds to a phase length of "0." In this case, the phase in which index number "0" is set is skipped.

FIGS. 11B to 11D respectively show a setting example of a drive waveform corresponding to normal temperature, a drive waveform corresponding to temperatures lower than the temperature range in which the drive waveform in FIG. 11B is used, and a drive waveform corresponding to temperatures higher than the temperature range in which the drive waveform in FIG. 11B is used in drive mode 2 (low-ghost mode). Waveform information representing five times of iteration of all-white all-black drive, for example, may be stored in the waveform information storage section 222. By setting the phase length "0" for this waveform information depending on the temperature, the number of times of iteration of all-white all-black drive can be reduced.

In the case of normal temperature shown in FIG. 11B, with index number "0" set twice, the number of times of setting of index number "2" is four, resulting in two times of white-black reversal. In the case of low temperature shown in FIG. 11C, with no index number "0" set, the number of times of setting of index number "2" is six, resulting in three times of white-black reversal. In the case of high temperature shown in FIG. 11D, with index number "0" set four times, the number of times of setting of index number "2" is two, resulting in one time of white-black reversal.

Alternatively, the drive waveform can be changed depending on the drive mode by setting the phase length "0," without the necessity of storing waveform information for a plurality of drive modes in the waveform information storage section 222. That is, even using the same waveform information and the same end phase position information, the virtual number of phases can be changed by setting the phase length "0."

For example, waveform information representing five times of iteration of all-white all-black drive may be stored in the waveform information storage section 222. The phase length "0" may be set for the phase numbers corresponding to the five times of iteration of all-white all-black drive in the high-speed mode, to cancel the all-white all-black drive. Also, the phase length "0" may not be set in the low-ghost drive, to perform the five times of iteration of all-white all-black drive.

Fourth Setting Example of Drive Waveforms

Figure 12:
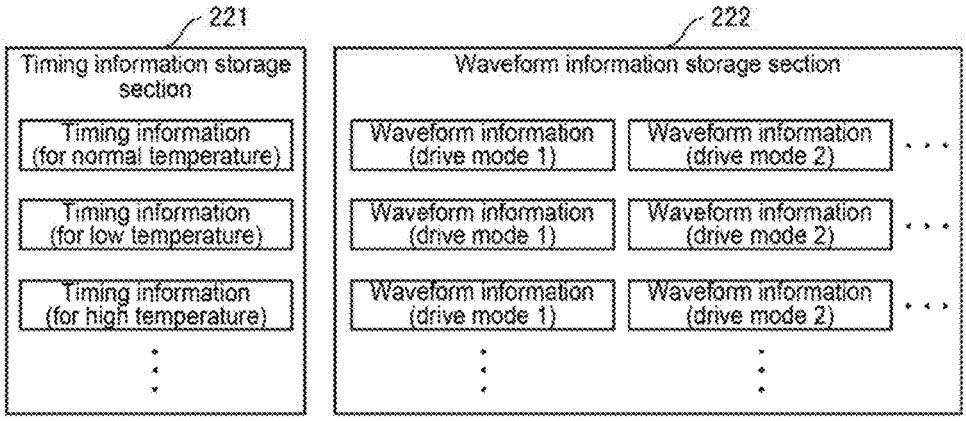
FIG. 12 is a view showing the fourth setting example of drive waveforms in the first embodiment of the invention.

FIG. 12 is a view showing the fourth setting example of drive waveforms according to the first embodiment of the invention. As shown in FIG. 12, in the fourth setting example, the timing information storage section 221 stores a plurality of kinds of timing information used in a plurality of different environmental conditions, and the waveform information storage section 222 stores a plurality of kinds of waveform information for the kinds of timing information.

For example, the timing information storage section 221 stores timing information for normal temperature, timing information for low temperature, and timing information for high temperature. The waveform information storage section 222 stores waveform information in drive mode 1 and waveform information in drive mode 2 for each of the units of timing information for normal temperature, low temperature, and high temperature. According to the fourth setting example, not only the phase time but also the waveform itself can be changed depending on a plurality of different environmental conditions.

Fifth Setting Example of Drive Waveform

While both the frame time and the phase length are changed depending on the environmental conditions in the above setting examples, either the frame time or the phase length may be fixed. For example, when the frame time is fixed, the phase time is changed by changing the index number (phase length). When the phase length is fixed, the phase time is changed by changing the frame time information.

Sixth Setting Example of Drive Waveform

While the phase time or the waveform is changed depending on the temperature in the above setting examples, the phase time or the waveform may be changed depending on the temperature, the humidity, the atmospheric pressure, or a combination of two or more of these. For example, the phase time can be shortened when the humidity is low.

Seventh Setting Example of Drive Waveform

While the waveform is changed depending on the two modes, the high-speed mode and the low-ghost mode, in the above setting examples, the mode type is not limited to these. For example, the waveform may be changed depending on three or more modes such as a high-quality low-ghost mode having lowest ghost, a low-flashing mode capable of reducing the white-black reversal at resetting to a half theoretically, and a high-speed mode of putting emphasis on speed although having high ghost.

Eighth Setting Example of Drive Waveform

While the top plane electrode and the plurality of segment electrodes are driven simultaneously in the above setting examples, the invention is also applicable to a matrix-style electrooptic panel. In this case, a plurality of scanning lines and a plurality of data lines are sequentially driven, but drive waveforms applied to pixel electrodes are equivalent to the drive waveforms applied to the segment electrodes. Therefore, timing information and waveform information similar to those in the above setting examples can be used.

Specific Examples of Drive Waveforms

Next, specific examples of drive waveforms generated by the display driver shown in FIG. 4 will be described. In an electrooptic panel, black display or white display is exhibited depending on the polarity of a drive bias applied between a segment electrode and the top plane electrode. A color filter may be interposed to impart a specific color to the white display. In this case, the white color of the white display can be replaced with the color of the color filter. Also, in place of the black display and the white display, red display and blue display may be exhibited by using red particles as one kind of the electrophoretic particles and blue particles as the other kind thereof.

Figure 13:
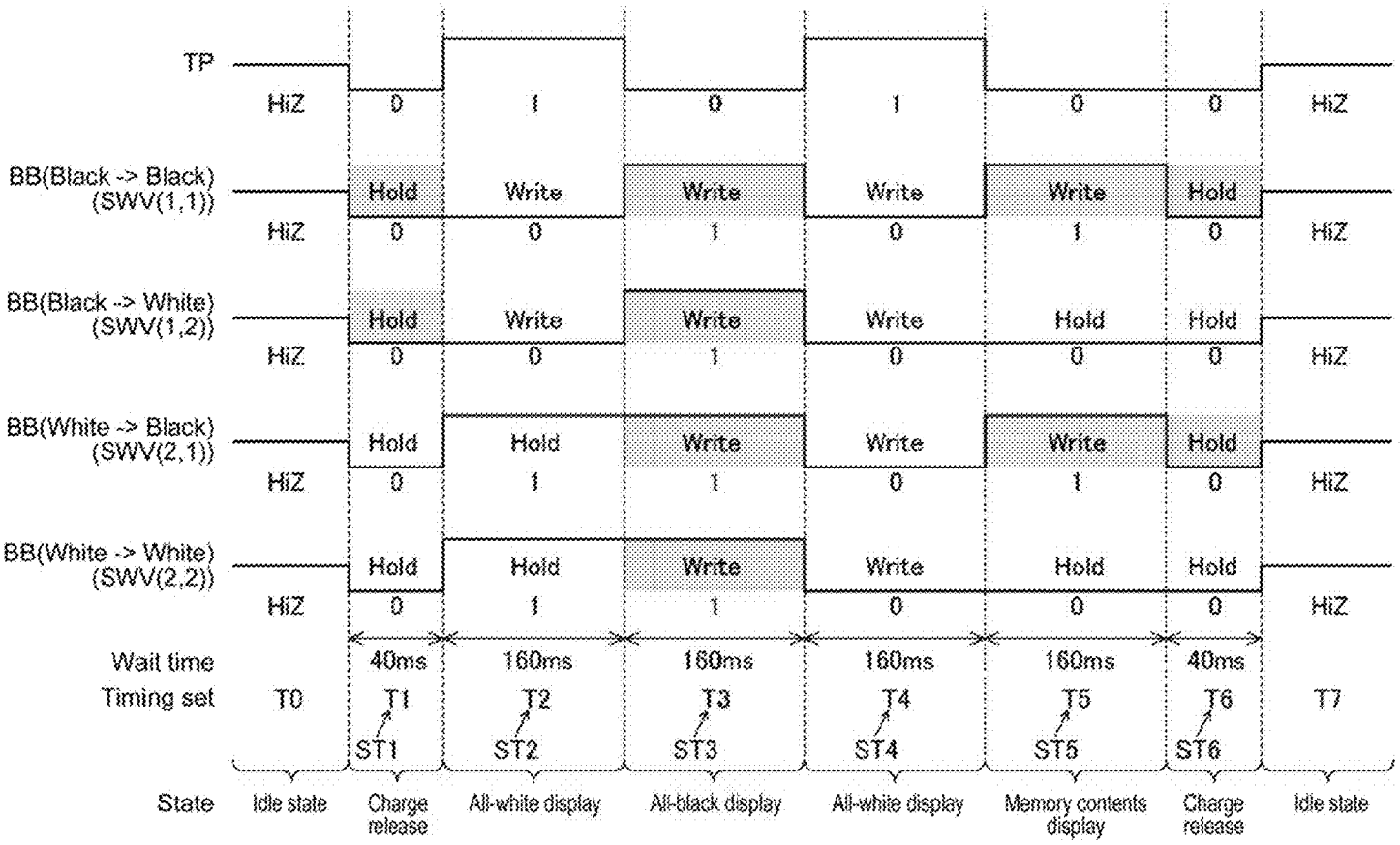
FIG. 13 is a view showing an example of drive waveforms generated by the display driver shown in FIG. 4.

FIG. 13 is a waveform chart showing an example of drive waveforms generated by the display driver shown in FIG. 4. In FIG. 13, "TP" represents a waveform value of the top plane signal. "BB," "BW,", "WB," and "WW" represent waveform values of the segment signals, which respectively correspond to the segment signals SWV(1,1), SWV(1,2), SWV(2,1), and SWV(2,2). For example, the waveform value "0" represents a drive voltage of 0 V, and the waveform value "1" represents a drive voltage of 15 V.

Referring to FIG. 13, the drive waveform represented by the segment signal SWV(1,1) will be described. After the first display (black display) corresponding to the first display data DL, during period T0 when the first display state is maintained, the top plane electrode and the segment electrode are put in an idle state (high-impedance state: HiZ). Thereafter, during charge release period T1, where TP=0 and BB=0, no bias is applied between the top plane electrode and the segment electrode, to release the charge. Thus, the black display is maintained (Hold).

During all-white display period T2, where TP=1 and BB=0, the top plane electrode is in a positively biased state with respect to the segment electrode, changing the display state from black display to white display (Write). During all-black display period T3, where TP=0 and BB=1, the top plane electrode is in a negatively biased state with respect to the segment electrode, changing the display state from white display to black display (Write). During all-white display period T4, where TP=1 and BB=0, the top plane electrode is in a positively biased state with respect to the segment electrode, changing the display state from black display to white display (Write).

During memory contents display period T5, where TP=0 and BB=1, the top plane electrode is in a negatively biased state with respect to the segment electrode, changing the display state from white display to black display (Write). Thus, the second display (black display) corresponding to the second display data DP is exhibited. During charge release period T6, where TP=0 and BB=0, the charge is released (Hold). During subsequent period T7, the top plane electrode and the segment electrode are put in an idle state, maintaining the second display state.

The timing control section 223 shown in FIG. 4 sets the length of each period (phase time) based on the index number read from the storage areas RT1 to RTM of the waveform information storage section 222 (timing set). Thus, as shown in FIG. 13, the lengths of periods T1 to T6 are set based on index numbers ST1 to ST6.

As shown in FIG. 13, by repeating black display and white display over a plurality of periods set at a predetermined length before display of memory contents, high-quality display of the electrooptic panel can be achieved. In other words, for the electrooptic panel, the display quality can be improved by sequentially changing the signal level over a plurality of periods at the time of transition from the first display state corresponding to the first display data DL to the second display state corresponding to the second display data DP.

In the integrated circuit device according to the first embodiment of the invention, by storing the phase length information in the timing information storage section 221 in correspondence with the index number, it is only necessary to store the index number small in the number of bits, in place of the phase length information, for each phase in the waveform information storage section 222 for setting of the drive voltage application period. Thus, the data area in the integrated circuit device can be reduced.

Moreover, in compensation of drive waveforms in response to a change in environmental condition such as temperature, also, it is only necessary to change or select phase length information stored in the timing information storage section 221. In the waveform information storage section 222, the same index number can be used in common for different environmental conditions. Thus, the communication amount and the load on the host CPU, etc. can be reduced, and also the data area in the integrated circuit device can be reduced.

Second Embodiment

Next, the second embodiment of the invention will be described. In the second embodiment, the waveform information storage section 222 shown in FIG. 4 stores waveform information related to at least one set of drive waveforms used in response to one display state determined by the display data DP stored in the display data storage section 21. Therefore, the display data storage section 21 needs to have only the next display data storage section 212 that stores the display data DP. Also, the selector 231 of the drive voltage generation section 23 selects a waveform value representing a drive voltage to be applied to each electrode of the electrooptic panel, out of one set of waveform values selected by the drive waveform selection section 224, in accordance with the display data DP stored in the display data storage section 21. The other part of this embodiment is similar to that of the first embodiment shown in FIG. 4, etc.

As one set of drive waveform signals representing one set of drive waveforms during the time until the display state of the electrooptic panel changes from the first display state to the second display state, segment signals SWV(1) to SWV (L) and a top plane signal TP are used, where L represents the number of gradations of the display data and is an integer equal to or more than 2. As an example, the case of L=2 will be described hereinafter.

When the number of gradations of the display data is two, there are two states of black display and white display as the second display state corresponding to the display data DP. Thus, the segment signal SWV(1) represents a drive waveform supplied to a segment electrode when the second display state is black display. Also, the segment signal SWV(2) represents a drive waveform supplied to a segment electrode when the second display state is white display.

The storage areas RT1 to RTM of the waveform information storage section 222 store the waveform values of the segment signals SWV(1) to SWV(2) and the waveform value of the top plane signal TP during periods T1 to TM, respectively. For example, the storage area RT1 stores the waveform values of the segment signals SWV(1) to SWV(2) and the waveform value of the top plane signal TP during period T1. This also applies to the storage areas RT2 to RTM.

FIG. 14 is a view showing a setting example of drive waveforms in the second embodiment of the invention. FIG. 14 shows the waveform information stored in the waveform information storage section 222 of the display controller 22 shown in FIG. 4, as well as the phase length, the phase time, etc. corresponding to the waveform information. In FIG. 14, "TP" represents the waveform value of the top plane signal. Also, "B" and "W" represent the waveform values of the segment signals, which respectively correspond to the segment signals SWV(1) and SWV(2).

The waveform information storage section 222 shown in FIG. 4 stores the waveform values TP, B, and W and the index numbers for each phase. The counter setting section 303 of the timing control section 223 can read the phase length by referring to the timing information storage section 221 based on the index number designated in the waveform information stored in the waveform information storage section 222. Further, the phase time is determined by the product of the frame time and the phase length. Thus, flexible waveforms can be generated by the combination of the frame time and the phase length. According to the second embodiment of the invention, since the current display data storage section 211 shown in FIG. 4 is unnecessary, and the data amount is reduced, cost reduction can be achieved.

Third Embodiment

Next, the third embodiment of the invention will be described. In the third embodiment, the top plane electrode is fixed to a constant potential (e.g., 0 V), and the drive voltages applied to the segment electrodes have ternary values, not binary values. Thus, in comparison with the first embodiment shown in FIG. 4, the top plane signal TP and the drive circuit 233 are unnecessary, and the segment signals SWV(1,1) to SWV(2,2) have ternary values. The other part of this embodiment is similar to that of the first embodiment shown in FIG. 4, etc.

FIG. 15 is a view showing a setting example of drive waveforms in the third embodiment of the invention. FIG. 15 shows the waveform information stored in the waveform information storage section 222 of the display controller 22 shown in FIG. 4, as well as the phase length, the phase time, etc. corresponding to the waveform information, in drive mode 1 (high-speed mode). For example, the waveform value "0" represents a drive voltage of 0 V, the waveform value "+1" represents a drive voltage of +15 V, and the waveform value "−1" represents a drive voltage of −15 V.

The waveform information storage section 222 shown in FIG. 4 stores the waveform values BB, BW, WB, and WW and the index number for each phase. The counter setting section 303 of the timing control section 223 can read the phase length by referring to the timing information storage section 221 based on the index number designated in the waveform information stored in the waveform information storage section 222. Further, the phase time is determined by the product of the frame time and the phase length. Thus, flexible waveforms can be generated by the combination of the frame time and the phase length. According to the third embodiment of the invention, since the top plane signal TP is unnecessary, the control of the electrooptic panel is simplified. Also, since the transition from the white display state to the black display state and the transition from the black display state to the white display state can be performed simultaneously, the rewrite speed can be increased.

Next, a control method for the electrooptic panel used in the integrated circuit devices according to the first to third embodiments of the invention will be described with reference to FIGS. 1, 4, and 16.

Figure 16:
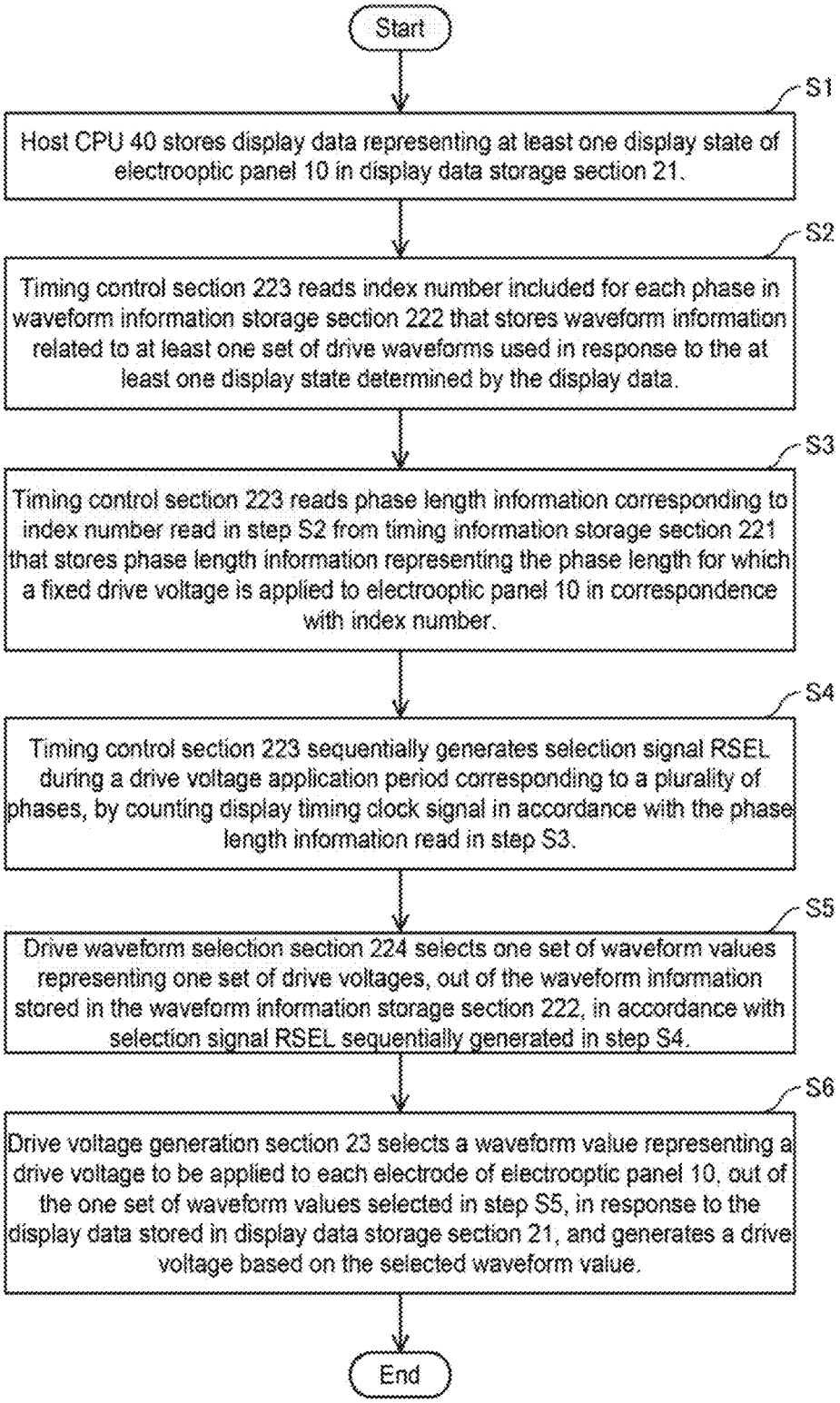
FIG. 16 is a flowchart showing a control method for an electrooptic panel according to an embodiment of the invention.

FIG. 16 is a flowchart showing a control method for an electrooptic panel according to an embodiment of the invention. This control method is a method for controlling the electrooptic panel 10 with a series of drive voltages in a plurality of phases.

As a precondition, for example, the host CPU 40 writes timing information and waveform information in the timing information storage section 221 and the waveform information storage section 222, respectively. When the timing information storage section 221 and the waveform information storage section 222 are nonvolatile memories, the host CPU 40 may write necessary data at the factory shipment of the integrated circuit device. Alternatively, when the timing information storage section 221 and the waveform information storage section 222 are registers, the host CPU 40 may write necessary data at power-up of the integrated circuit device.

Thereafter, at the time of display of an image on the electrooptic panel 10, in step S1 shown in FIG. 16, the host CPU 40 stores display data representing at least one display state of the electrooptic panel 10 in the display data storage section 21, for example. Then, in step S2, the timing control section 223 reads an index number included for each phase in the waveform information storage section 222 that stores waveform information related to at least one set of drive waveforms used in response to the at least one display state determined by the display data.

In step S3, the timing control section 223 reads phase length information corresponding to the index number read in step S2 from the timing information storage section 221 that stores phase length information representing a phase length for which a fixed drive voltage is applied to the electrooptic panel 10 in correspondence with an index number.

Further, in step S4, the timing control section 223 sequentially generates the selection signal RSEL during the drive voltage application period corresponding to a plurality of phases, by counting the display timing clock signal in accordance with the phase length information read in step S3.

In step S5, the drive waveform selection section 224 selects one set of waveform values representing one set of drive voltages, out of the waveform information stored in the waveform information storage section 222, in accordance with the selection signal RSEL sequentially generated in step S4.

In step S6, the drive voltage generation section 23 selects a waveform value representing a drive voltage to be applied to each electrode of the electrooptic panel 10, out of the one set of waveform values selected in step S5, in response to the display data stored in the display data storage section 21, and generates a drive voltage based on the selected waveform value.

In the control method for an electrooptic panel according to an embodiment of the invention, by storing the phase length information in the timing information storage section 221 in correspondence with the index number, it is only necessary to store the index number small in the number of bits, in place of the phase length information, for each phase in the waveform information storage section 222 for setting of the drive voltage application period. Thus, the data areas in the timing information storage section 221 and the waveform information storage section 222 can be reduced.

Moreover, in compensation of the drive waveform in response to a change in environmental condition such as temperature, also, it is only necessary to change or select the phase length information stored in the timing information storage section 221. In the waveform information storage section 222, the same index number can be used in common for different environmental conditions. Thus, the communication amount and the load on the host CPU, etc. can be reduced, and also the data areas in the timing information storage section 221 and the waveform information storage section 222 can be reduced.

The invention is not limited to the embodiments described above, but many variations can be made by those skilled in the art within the technical idea of the invention.

When the control section executes the control operations in accordance with a program, the program may be implemented by a combination of a plurality of programs, and may be presented as being recorded in a computer-readable recording medium such as a magnetic recording medium, an optical recording medium, a magneto-optical recording medium, and a semiconductor memory. Such a program can otherwise be downloaded via a communication network such as the Internet. The timing information and the waveform information according to the invention can also be presented as being recorded in a recording medium or via a communication network.

This application claims priority from Japanese Patent Applications No. 2014-127928 filed in the Japanese Patent Office on Jun. 23, 2014 and No. 2015-036290 filed in the Japanese Patent Office on Feb. 26, 2015 are expressly incorporated by reference herein.

What is claimed is:

1. An integrated circuit device that sets a drive waveform for an electrooptic panel driven in a plurality of phases, the device comprising:

a timing information storage section where phase length information is stored in correspondence with an index number, the phase length information representing a phase length for which a drive voltage is applied to the electrooptic panel;

a waveform information storage section where waveform information is stored, the wave information being related to a plurality of drive waveforms used in response to at least one display state determined by display data;

a timing control section that reads a phase index number included for each phase in waveform information stored in the waveform information storage section, reads from the timing information storage section a phase length information that corresponds to the phase index number by matching the phase index number with a stored index number, and sequentially generates a selection signal during a drive voltage application period corresponding to a plurality of phases in accordance with the phase length information; and a drive waveform selection section that selects a waveform value representing a drive voltage, out of a plurality of units of waveform information stored in the waveform information storage section, in accordance with the selection signal sequentially generated by the timing control section.

2. The integrated circuit device according to claim 1, further comprising:

a display data storage section that stores display data representing at least one display state of the electrooptic panel; and a drive voltage generation section that selects a waveform value representing a drive voltage to be applied to each electrode of the electrooptic panel, out of one set of waveform values selected by the drive waveform selection section, in response to display data stored in the display data storage section, and generate a drive voltage based on the selected waveform value.

3. The integrated circuit device according to claim 1, wherein the waveform information storage section stores waveform information related to a plurality of sets of drive waveforms in correspondence with a plurality of drive modes, and the drive waveform selection section selects one set of waveform values representing one set of drive voltages, out of waveform information related to one set of drive waveforms corresponding to a designated drive mode, in accordance with the selection signal sequentially generated by the timing control section.

4. The integrated circuit device according to claim 1, wherein the timing information storage section further stores frame time information representing the time of one frame, and the timing control section includes a clock frequency regulator circuit that regulates the frequency of the display timing clock signal in accordance with the frame time information stored in the timing information storage section.

5. The integrated circuit device according to claim 1, wherein the waveform information storage section stores end phase position information specifying the position of a phase in which application of a drive voltage is terminated at the head of a storage area where waveform information related to one set of drive waveforms is stored, and the timing control section stops generation of the selection signal after generating the selection signal during the drive voltage application period corresponding to a phase at the position specified by the end phase position information stored in the waveform information storage section.

6. The integrated circuit device according to claim 1, wherein the timing information storage section stores a plurality of kinds of timing information used under a plurality of different environmental conditions.

7. The integrated circuit device according to claim 6, further comprising a control section that selects one kind of timing information, out of the plurality of kinds of timing information stored in the timing information storage section, depending on an environmental condition measured by an environmental condition sensor.

8. An electronic apparatus comprising:

an electrooptic panel; and the integrated circuit device according to claim 1.

9. A method for controlling an electrooptic panel in a plurality of phases, the method comprising:

(a) storing display data representing at least one display state of the electrooptic panel in a display data storage section;

(b) reading a phase index number included for each phase in a waveform information storage section that stores waveform information related to at least one set of drive waveforms used in response to at least one display state determined by display data;

(c) reading a phase length information that corresponds to the index number read in step (b) from the timing information storage section by matching the phase index number with a stored index number that corresponds with the stored phase length information representing the phase length for which a drive voltage is applied to the electrooptic panel in correspondence with an index number;

(d) sequentially generating a selection signal during a drive voltage application period corresponding to a plurality of phases in accordance with the phase length information read in step (c);

(e) selecting one set of waveform values representing one set of drive voltages, out of waveform information stored in the waveform information storage section, in accordance with the selection signal sequentially generated in step (d); and (f) selecting a waveform value representing a drive voltage to be applied to each electrode of the electrooptic panel, out of one set of waveform values selected in step (e), in response to display data stored in the display data storage section, and generating a drive voltage based on the selected waveform value.

* * * * *